US010472727B2

(12) United States Patent
Lomasney

(10) Patent No.: US 10,472,727 B2
(45) Date of Patent: Nov. 12, 2019

(54) METHOD AND APPARATUS FOR CONTINUOUSLY APPLYING NANOLAMINATE METAL COATINGS

(71) Applicant: Modumetal, Inc., Seattle, WA (US)

(72) Inventor: Christina A. Lomasney, Seattle, WA (US)

(73) Assignee: MODUMETAL, INC., Seattle, WA (US)

( * ) Notice: Subject to any disclaimer, the term of this patent is extended or adjusted under 35 U.S.C. 154(b) by 0 days.

(21) Appl. No.: 15/464,245

(22) Filed: Mar. 20, 2017

(65) Prior Publication Data

US 2017/0191178 A1 Jul. 6, 2017

Related U.S. Application Data

(63) Continuation of application No. PCT/US2015/050932, filed on Sep. 18, 2015.

(Continued)

(51) Int. Cl.

| | |
|---|---|
| ***C25D 5/10*** | (2006.01) |
| ***C25D 7/06*** | (2006.01) |
| ***C25D 5/12*** | (2006.01) |
| ***C25D 5/18*** | (2006.01) |
| ***C25D 5/56*** | (2006.01) |
| ***C25D 7/04*** | (2006.01) |
| ***C25D 5/34*** | (2006.01) |
| ***C25D 5/48*** | (2006.01) |
| ***C25D 17/02*** | (2006.01) |

(Continued)

(52) U.S. Cl.

CPC ..... *C25D 5/12* (2013.01); *C25D 5/08* (2013.01); *C25D 5/10* (2013.01); *C25D 5/18* (2013.01); *C25D 5/34* (2013.01); *C25D 5/48* (2013.01); *C25D 5/56* (2013.01); *C25D 7/04* (2013.01); *C25D 7/0607* (2013.01); *C25D 17/00* (2013.01); *C25D 17/02* (2013.01); *C25D 21/10* (2013.01); *C25D 21/12* (2013.01); *C23C 18/1653* (2013.01)

(58) Field of Classification Search

CPC ..... C25D 5/10; C25D 7/06
USPC ..... 205/170
See application file for complete search history.

(56) References Cited

U.S. PATENT DOCUMENTS

| | | | |
|---|---|---|---|
| 2,558,090 | A | 6/1951 | Jernstedt |
| 2,891,309 | A | 6/1959 | Fenster |

(Continued)

FOREIGN PATENT DOCUMENTS

| | | | |
|---|---|---|---|
| CN | 102148339 | A | 8/2011 |
| EP | 2 544 282 | A1 | 1/2013 |

(Continued)

OTHER PUBLICATIONS

"Improvement of Galvanneal Coating Adherence on Advanced High Strength Steel," Appendix 1: Literature review (Task 1), Progress Report No. 1 to Galvanized Autobody Partnership Program of International Zinc Association, Brussels, Belgium, Jun. 2008-Jul. 2009, 70 pages, Issued: Sep. 2009.

(Continued)

*Primary Examiner* — Bryan D. Ripa
(74) *Attorney, Agent, or Firm* — Seed Intellectual Property Law Group LLP

(57) ABSTRACT

Described herein are apparatus and methods for the continuous application of nanolaminated materials by electrodeposition.

27 Claims, 11 Drawing Sheets

Related U.S. Application Data

(60) Provisional application No. 62/052,345, filed on Sep. 18, 2014.

(51) Int. Cl.

| | |
|---|---|
| ***C25D 21/10*** | (2006.01) |
| ***C25D 5/08*** | (2006.01) |
| ***C25D 17/00*** | (2006.01) |
| ***C25D 21/12*** | (2006.01) |
| *C23C 18/16* | (2006.01) |

(56) References Cited

U.S. PATENT DOCUMENTS

| | | | | |
|---|---|---|---|---|
| 3,483,113 | A | 12/1969 | Carter | |
| 4,314,893 | A | 2/1982 | Clauss | |
| 4,405,427 | A | 9/1983 | Byrd | |
| 4,464,232 | A | 8/1984 | Wakano et al. | |
| 4,519,878 | A * | 5/1985 | Hara | C25D 3/562 205/141 |
| 4,540,472 | A | 9/1985 | Johnson et al. | |
| 4,543,300 | A | 9/1985 | Hara et al. | |
| 4,834,845 | A | 5/1989 | Muko et al. | |
| 5,043,230 | A | 8/1991 | Jagannathan et al. | |
| 5,228,967 | A | 7/1993 | Crites et al. | |
| 5,800,930 | A | 9/1998 | Chen et al. | |
| 5,942,096 | A | 8/1999 | Ruzicka et al. | |
| 6,344,123 | B1 | 2/2002 | Bhatnagar | |
| 6,592,739 | B1 | 7/2003 | Sonoda et al. | |
| 8,253,035 | B2 | 8/2012 | Matsumoto | |
| 8,585,875 | B2 | 11/2013 | Cummings et al. | |
| 2002/0070118 | A1 | 6/2002 | Schreiber et al. | |
| 2006/0201817 | A1 | 9/2006 | Guggemos et al. | |
| 2006/0243597 | A1 | 11/2006 | Matefi-Tempfli et al. | |
| 2006/0272949 | A1* | 12/2006 | Detor | C25D 3/56 205/238 |
| 2007/0269648 | A1* | 11/2007 | Schuh | C25D 3/56 428/323 |
| 2007/0278105 | A1 | 12/2007 | Ettel | |
| 2008/0093221 | A1 | 4/2008 | Basol | |
| 2008/0245669 | A1 | 10/2008 | Yoshioka et al. | |
| 2008/0271995 | A1 | 11/2008 | Savastiouk et al. | |
| 2009/0101511 | A1 | 4/2009 | Lochtman et al. | |
| 2010/0319757 | A1 | 12/2010 | Oetting | |
| 2011/0162970 | A1 | 7/2011 | Sato | |
| 2011/0186582 | A1 | 8/2011 | Whitaker et al. | |
| 2012/0088118 | A1* | 4/2012 | Lomasney | C25D 5/10 428/615 |
| 2012/0231574 | A1 | 9/2012 | Wang | |
| 2013/0071755 | A1 | 3/2013 | Oguro | |
| 2013/0075264 | A1 | 3/2013 | Cummings et al. | |
| 2013/0130057 | A1* | 5/2013 | Caldwell | C25D 1/00 428/626 |
| 2013/0220831 | A1 | 8/2013 | Vidaurre Heiremans et al. | |

FOREIGN PATENT DOCUMENTS

| | | | |
|---|---|---|---|
| JP | 58-197292 | | 11/1983 |
| WO | 02/33150 | A2 | 4/2002 |
| WO | 2005/026415 | A1 | 3/2005 |
| WO | 2007/136387 | A1 | 11/2007 |
| WO | 2010/124301 | A2 | 10/2010 |
| WO | 2010/144509 | A2 | 12/2010 |
| WO | 2013/133762 | A1 | 9/2013 |

OTHER PUBLICATIONS

Wilcox, "Surface Modification With Compositionally Modulated Multilayer Coatings," JCSE, vol. 6 Paper 52, 2004, 5 pages.

Yogesha et al., "Optimization of deposition conditions for development of high corrosion resistant Zn—Fe multilayer coatings," Journal of Materials Processing Technology, 211 (2011) 1409-1415.

* cited by examiner

METHOD AND APPARATUS FOR CONTINUOUSLY APPLYING NANOLAMINATE METAL COATINGS

CROSS-REFERENCE TO RELATED APPLICATIONS

This application is a continuation of International Patent Application No. PCT/US2015/050932, filed Sep. 18, 2015, which claims the benefit of U.S. Provisional Patent Application No. 62/052,345, filed Sep. 18, 2014, each of which application is incorporated herein by reference in its entirety. In addition, the disclosures of U.S. Provisional Application No. 61/802,102, filed Mar. 15, 2013, and International Patent Application PCT/US2014/31101, filed Mar. 18, 2014, are incorporated by reference herein in their entirety.

BACKGROUND

Nanolaminate materials have become widely studied over the past several decades. As a result some desirable advanced performance characteristics of those materials have been discovered and their potential application in numerous fields recognized. While the potential application of nanolaminated materials in numerous areas, including civil infrastructure, automotive, aerospace, electronics, and other areas, has been recognized, the materials are on the whole not available in substantial quantities due to the lack of a continuous process for their production.

SUMMARY

Described herein are apparatus and methods for the continuous application of nanolaminated materials by electrodeposition.

In some embodiments, the method imparts a stable mechanical and chemical finish to materials (e.g., steel) that is resistant to corrosion or that can receive a durable finish (e.g., paint powder coat, etc.).

DETAILED DESCRIPTION

1.0 Definitions

"Electrolyte" as used herein means an electrolyte bath, plating bath, or electroplating solution from which one or more metals may be electroplated.

"Workpiece" means an elongated conductive material or loop of conductive material.

"Nanolaminate" or "nanolaminated" as used herein refers to materials or coatings that comprise a series of layers less than 1 micron.

All compositions given as percentages are given as percent by weight unless stated otherwise.

2.0 Electrodeposition Apparatus for Continuous Application of Nanolaminated Coatings

2.1 Exemplary Electrodeposition Apparatus

FIGS. 1A-19 show various process units that may be used in various combinations to form a continuous electrodeposition process line capable of performing the continuous application of nanolaminate coatings on conductive materials.

Figure 1A:
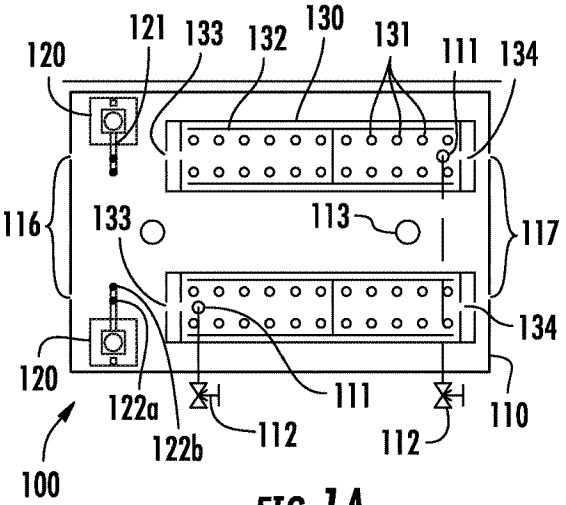
FIGS. 1A and 1B show a top and side view, respectively, of a plating cell according to various embodiments disclosed herein.
Figure 1B:
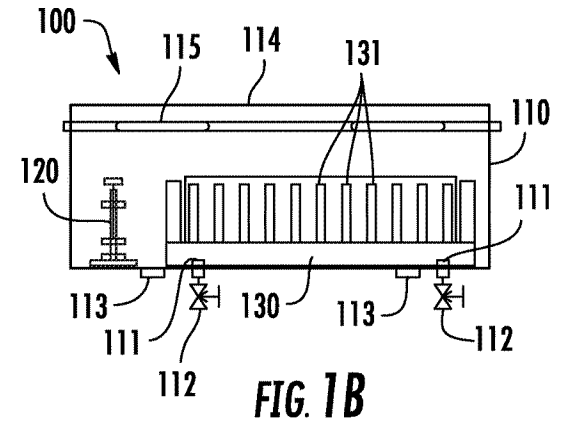

A main component of the process line is the plating cell 100 shown in FIGS. 1A and 1B. The plating cell 100 is where the application of nanolaminate coatings on conductive materials is carried out, and generally includes an enclosure 110, a cathode brush assembly 120, an anode assembly 130. As shown in FIGS. 1A and 1B, the plating cell 100 includes two each of the cathode brush assembly 120 and anode assembly 130 in enclosure 110 such that two workpieces can be plated in parallel.

The enclosure 110 is generally a tank or vessel in which the other components of the plating cell 100 are located. The enclosure 110 is capable of containing electrolyte solution within the walls of the enclosure 110. Any suitable material can be used for the enclosure, including, for example, polypropylene. The dimensions of the enclosure are generally not limited. In some embodiments, the enclosure is approximately 3 feet long, 2 feet wide, and 1 foot, 2 inches tall.

The enclosure 110 includes one or more inlets 111 where electrolyte solution can be introduced into the enclosure 110. The flow of electrolyte solution into the enclosure 110 via the inlets 111 can be controlled via flow control valves 112. In some embodiments, the inlets are positioned within the anode assembly 130 so that the inlets 110 provide electrolyte solution into the anode assembly 130 positioned within the enclosure 110. The enclosure 110 can also include one or more drains 113 for allowing electrolyte solution to be drained from the enclosure 110. The enclosure 110 can be covered with a fold back lid 114 so that the interior of the enclosure 110 can be sealed off from the outside environment. The enclosure 110 can also include one or more ventilation slots 115 for safely venting gases from the interior of the enclosure 110.

As shown in FIG. 1A, the enclosure 110 further includes an inlet passage 116 and an outlet passage 117 at opposite ends of the enclosure 110. The inlet passage 116 and the outlet passage 117 are generally narrow vertical slits (e.g., 0.5 inches wide) in the enclosure 110 through which the workpiece passes into and out of the enclosure 110. In some embodiments, the passages 116, 117 do not extend the entire height of the enclosure 110. In some embodiments, the passages 116, 117 terminate approximately 3 inches above the bottom of the enclosure 110. An inlet passage 116 and an outlet passage 117 is provided for each line in the enclosure 110. For example, in the configuration shown in FIG. 1A, the enclosure 110 will include two inlet passages 116 and two outlet passages 117, one each for the parallel two process lines in the enclosure 110.

Although not shown in the remaining figures, similar inlet and outlet passages can be provided in all of the units described herein to allow for passage of the workpiece into and out of the individual units.

The cathode brush assembly 120 provides a manner for passing a current to the workpiece that will serve as the cathode in the plating cell 100. Accordingly, the cathode brush assembly 120 typically includes a structure that is connected to a power supply (not shown in FIGS. 1A and 1B) and is capable of passing a current to the workpiece as it passes against the cathode brush assembly 120. The cathode brush assembly can be made from any material suitable for receiving a voltage and conductively passing a current to the workpiece.

In some embodiments, the cathode brush assembly 120 includes an arm 121 extending from the cathode brush assembly 120. The arm 121 extending from the cathode brush assembly 120 can terminate at a vertically oriented rod 122*a*. A second vertical rod 122*b* may be spaced apart from the vertically oriented rod 122*a* to thereby form a narrow passage between the vertically oriented rods 122*a*, 122*b*. The workpiece passes through this passage and contacts the vertically oriented rod 122*a* to thereby pass a current to the workpiece. In some embodiments, one or both of the rods 122*a*, 122*b* are flexible.

The anode assembly 130 is an open vessel or tank located within the larger enclosure 110. The anode assembly 130 may include one or more vertical pillars 131 positioned throughout the anode assembly 130. In some embodiments, such as shown in FIG. 1A, the pillars 131 form two rows. The workpiece travels between the two rows of pillars 131, which are used as safety guards against the workpiece contacting the anode 132 located between the pillars 131 and the side walls of the anode assembly. In some embodiments, the vertical pillars 131 are perforated riser tubes.

The anode 132 in the anode assembly 130 may be made of any material suitable for use in electrodeposition of nanolaminate layers on a conductive material. The anode is connected to the same power supply (not shown in FIGS. 1A and 1B) as the corresponding cathode brush assembly 120 to thereby provide for the flow of electrons through the electrolyte solution and formation of nanolaminate layers on the workpiece. Electrolyte solution is contained within the anode assembly 130, and as a result, the plating of material on the workpiece passing through the anode assembly 130 takes place in the anode assembly 130.

The anode (which serves as an anode except during reverse pulses) may be inert or may be active, in which case the anode will contain the metal species that is to be deposited and will dissolve into solution during operation.

In some embodiments, the distance between the workpiece travelling through the plating cell 100 and the anode 132 may be adjusted in order to adjust various characteristics of the nanolaminate layers being deposited on the workpiece, such as the thickness of the nanolaminate layers. In some embodiments, the anode 132 is adjustable and may be positioned closer to the side walls of the anode assembly (in order to create a greater distance between the workpiece and the anode) or closer to the pillars (in order to decrease the distance between the workpiece and the anode). In some embodiments, the location of the workpiece as it travels through the anode assembly can be adjusted in order to move it closer or further away from a specific side wall of the anode assembly. In such embodiments, moving the workpiece so that it does not travel along a center line of the anode assembly (and is therefore not equidistant between the anodes at either side wall of the anode assembly) can result in different nanolaminate coatings depositing on either side of the workpiece (e.g., nanolaminate layers of differing thicknesses).

As shown in FIG. 1A, the anode assembly 130 further includes an inlet passage 133 and an outlet passage 134 at opposite ends of the anode assembly 130. The inlet passage 133 and the outlet passage 134 are generally narrow vertical slits (e.g., 0.25 inches wide) in the anode assembly 130 through which the workpiece passes into and out of the anode assembly 130.

Although not shown in the remaining figures, similar inlet and outlet passages can be provided in any of the vessels disposed within larger units as described herein to allow for passage of the workpiece into and out of the vessels.

While not shown in FIGS. 1A and 1B, the plating cell, and more specifically, the anode assembly, may also include a mechanism for agitating the electrolyte solution. Mixing of electrolyte in the plating cell may be provided by solution circulation, a mechanical mixer, ultrasonic agitators, and/or any other manner of agitating a solution known to those of ordinary skill in the art. While bulk mixing can be provided by a mixer, which can be controlled or configured to operate at variable speeds during the electrodeposition process, the plating cell may optionally include one or more ultrasonic agitators. The ultrasonic agitators of the apparatus may be configured to operate independently in a continuous or in a non-continuous fashion (e.g., in a pulsed fashion). In one embodiment, the ultrasonic agitators may operate at about 17,000 to 23,000 Hz. In another embodiment, they may operate at about 20,000 Hz.

Figure 2A:
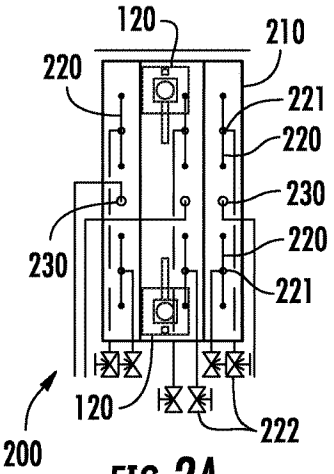
FIGS. 2A and 2B show a top and side view, respectively, of a triple rinse unit according to various embodiments disclosed herein.
Figure 2B:
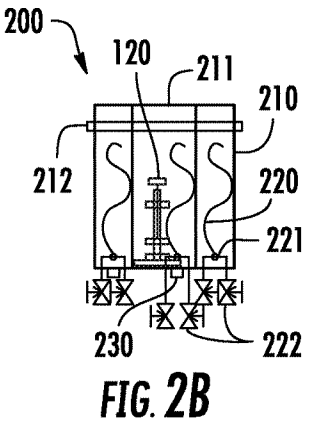
Figure 5A:
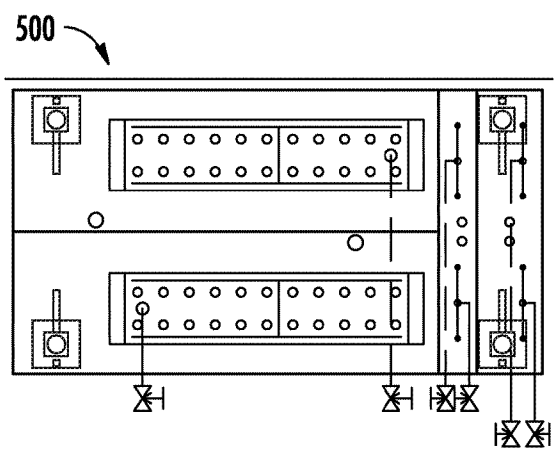
FIGS. 5A and 5B show a top and side view, respectively, of a combined plating cell and double rinse unit according to various embodiments disclosed herein.
Figure 5B:
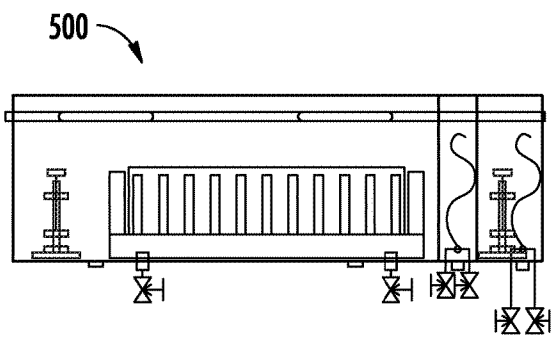
Figure 4A:
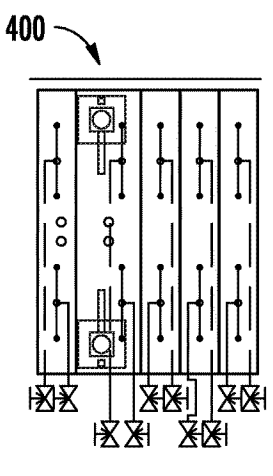
FIGS. 4A and 4B show a top and side view, respectively, of a quintuple rinse unit according to various embodiments disclosed herein.
Figure 4B:
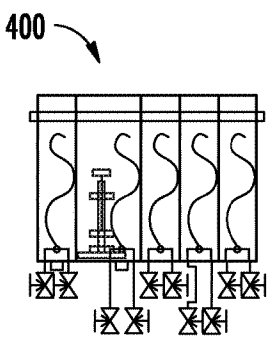

With reference to FIGS. 2A and 2B, a rinse unit 200 is shown wherein electrolyte and/or other process solutions may be rinsed off the workpiece. The rinse unit 200 shown in FIGS. 2A and 2B is a triple rinse unit containing three rinse stages. The rinse unit 200 can include any suitable number of stages. For example, FIGS. 4A and 4B show a quintuple rinse unit 400 including five rinse stages, while FIGS. 5A and 5B show a double rinse unit 500 paired with a plating cell 100. The depth and height of the rinse unit will typically be the same as the plating cell (e.g., 2 feet wide, 1 foot, 2 inches deep), while the length of the rinse unit will depend on the number of stages. In some embodiments, the triple rinse unit shown in FIGS. 2A and 2B is 1 foot long, the quintuple rinse shown FIGS. 4A and 4B is 1 foot, 6 and ⅝ inches long, and the double rinse unit shown in FIGS. 5A and 5B is 8 and ¾ inches long.

The rinse unit 200 generally includes an enclosure 210. The enclosure 210 is a closed tank or vessel through which the workpiece may pass. The enclosure 210 may be made from any suitable material, and in some embodiments, is made from polypropylene. The enclosure may include a lid 211 and an exhaust strip 212 for safely venting gas and vapor from the rinse unit 200. The enclosure 210 may also include inlet and outlet passages (not shown) located at either end of the enclosure to allow for the passage of the workpiece into and out of the enclosure 210. As with the inlet passages described above with respect to the enclosure 110 of the plating cell, the passages are generally narrow, vertical slits.

The rinse unit 200 further includes one or more spreader pipes 220 for each stage of the rinse unit 200. As shown in FIGS. 2A and 2B, each stage of the rinse unit 200 includes two spreader pipes 220. Rinse solution (e.g., water) is dispensed from the spreader pipes 220 to rinse process solution and/or other materials from the workpiece passing through the rinse unit 200. In some embodiments, the spreader pipe 220 is flexible tubing to allow for various positioning of the spreader pipe within the rinse unit 200.

Each spreader pipe 220 can be associated with a rinse inlet 221 that provides rinse solution into the rinse unit 200 via the spreader pipe 220. Each rinse inlet 221 may be controlled by a flow control valve 222. The rinse unit 200 may also include one or more drains 230 to allow for the draining of rinse solution and process solution from the rinse unit 200.

As shown in FIGS. 2A and 2B, the rinse unit may also include a cathode brush assembly 120. The cathode brush assembly is similar or identical to the cathode brush assembly 120 located in the plating cell 100 and described in greater detail above. The cathode brush assembly 120 serves as a guide to help guide the workpiece through the rinse unit. The cathode brush assembly 120 also provides a means to continue to charge the workpiece as it travels down the process line.

Figure 3A:
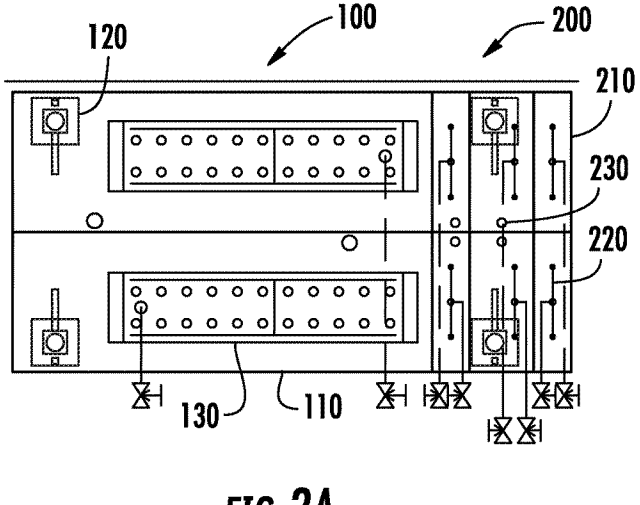
FIGS. 3A and 3B show a top and side view, respectively, of a combined plating cell and triple rinse unit according to various embodiments described herein.
Figure 3B:
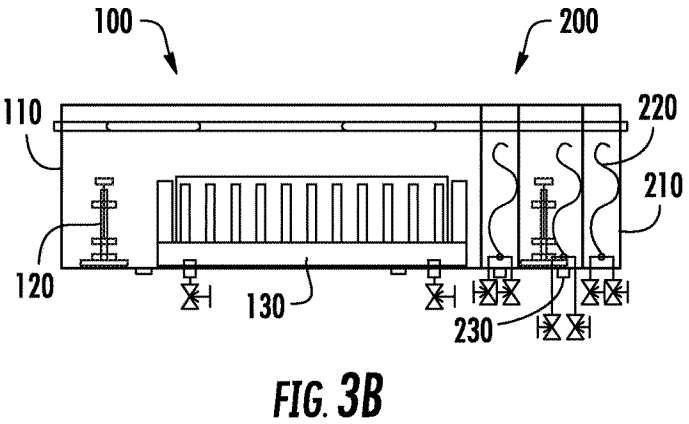

FIGS. 3A and 3B show a plating cell 100 and rinse unit 200 combined together to form a part of the overall process line for electrodeposition of nanolaminate material. In this configuration, the outlet passage 117 of the enclosure 110 of the plating cell is aligned with the inlet passage of the enclosure 210 of the rinse unit 200 so that the workpiece can move from the plating cell 100 into the rinse unit 200. In some embodiments, a saddle or seal (not shown) can be used to hold together the plating cell 100 and the rinse unit 200 and prevent leakage between the units. Similar saddles or seals can be used to join together any two units described herein in order to e.g., prevent leakage of process fluid out of the units and/or into an adjoining unit.

Figure 6A:
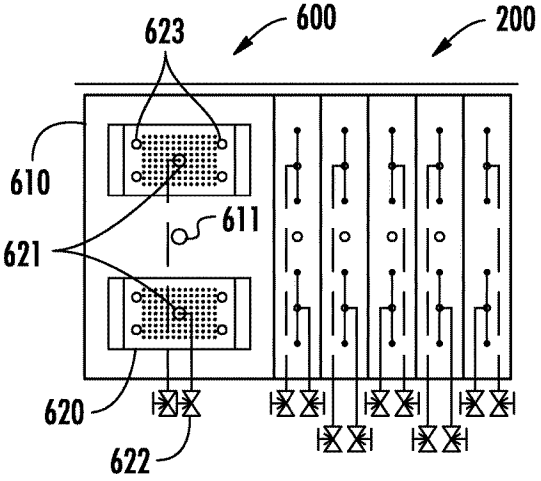
FIGS. 6A and 6B show a top and side view, respectively, of a combined immersion cell and quintuple rinse unit according to various embodiments disclosed herein.
Figure 6B:
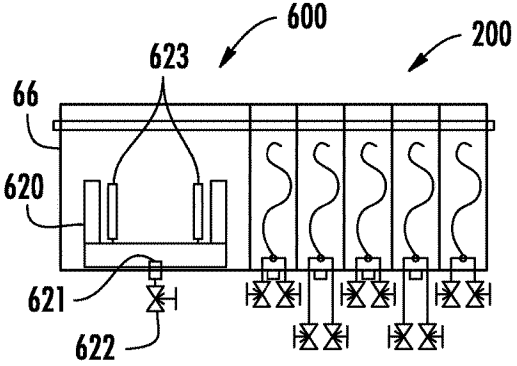

With reference now to FIGS. 6A and 6B, an immersion unit 600 combined with a rinse unit 200 (quintuple rinse) is shown. The immersion unit 600 can be used to carry out, for example, acid activation on the workpiece after the plating steps have been carried out. The immersion unit 600 generally includes an enclosure 610 and an immersion vessel 620 positioned within the enclosure 610.

The enclosure 610 is generally a tank or vessel suitable for containing the process solutions used in the acid activation step. The enclosure 610 can be made from any material suitable for containing the process solution used in an acid activation process. In some embodiments, the enclosure 610 includes one or more drains 611 for draining process solution out of the enclosure 610. The enclosure 610 may also include inlet and outlet passages which allow the workpiece to pass into and out of the enclosure 610. As described above with respect to, for example, the plating cell, the inlet and outlet passages may be narrow vertical gaps.

The immersion vessel 620 is a tank or vessel into which the process solution for acid activation is flowed. In some embodiments, the immersion vessel 620 includes a perforated plate floor through which process solution flows in order to fill the immersion vessel 620. Process solution may be introduced into the immersion vessel 620 via inlet 621. Flow of process solution into the immersion vessel 620 via inlet 621 can be controlled by flow control valve 622. The immersion vessel 620 may also include one or more guide rollers 623 around which the workpiece winds in order to increase the amount of time the workpiece remains in the immersion vessel 620. The immersion vessel 620 may include an inlet passage and an outlet passage at opposite ends of the immersion vessel so that the workpiece can pass into and out of the immersion vessel. The inlet and outlet passages are typically narrow vertical gaps.

Figure 7A:
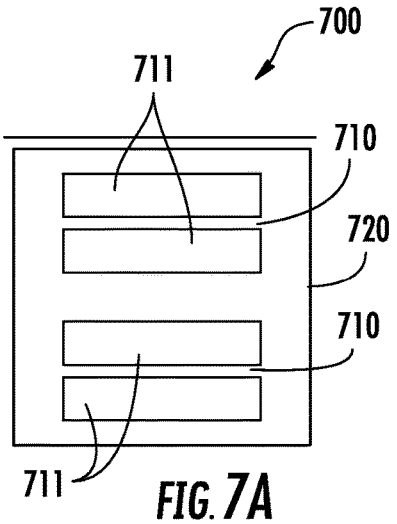
FIGS. 7A and 7B show a top and side view, respectively of a forced air dryer according to various embodiments disclosed herein.
Figure 7B:
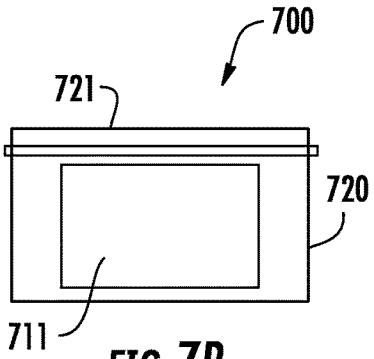

With reference to FIGS. 7A and 7B, a forced air dryer 700 suitable for use in the process line is shown. The forced air dryer 700 may be any suitable type of forced air dryer capable of drying the workpiece as it passes through the forced air dryer. As shown in FIGS. 7A and 7B, the forced air dryer 700 may be configured to include a narrow passage 710 through which the workpiece can pass. The narrow passage may be formed by insulated blocks 711. The forced air dryer 700 may be contained within an enclosure 720, such as the tank of a vessel, that includes a lid 721. In some embodiments, hot air is introduced into the forced air dryer 700 from one or more inlets located under the forced air dryer 700. The dimensions of the forced air dryer are generally not limited. In some embodiments, the forced air dryer has the same height and width as the other units of the process line (e.g., 2 feet wide, 1 foot, 2 inches tall), while the length is 2 feet long.

Figure 8A:
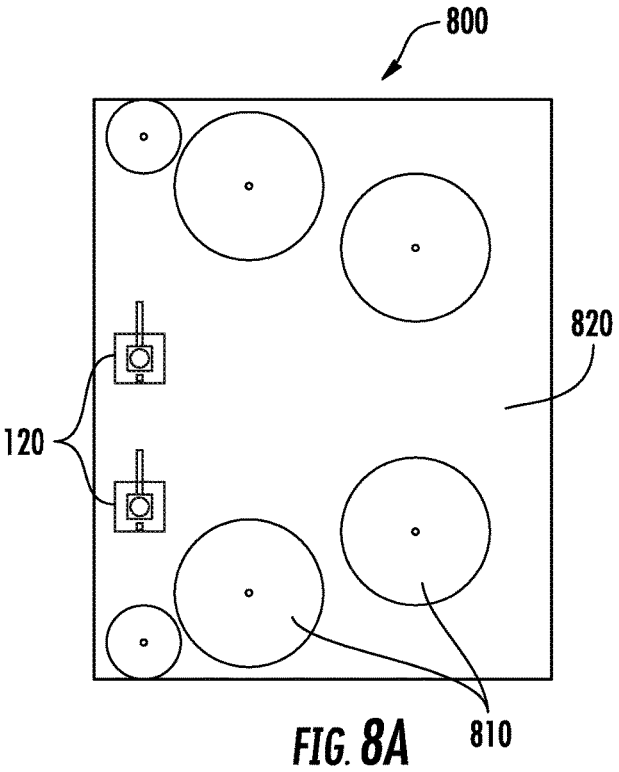
FIGS. 8A and 8B show a top and side view, respectively, of a strip puller according to various embodiments described herein.
Figure 8B:
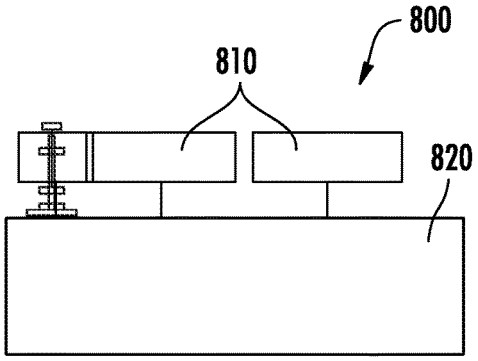
Figure 11A:
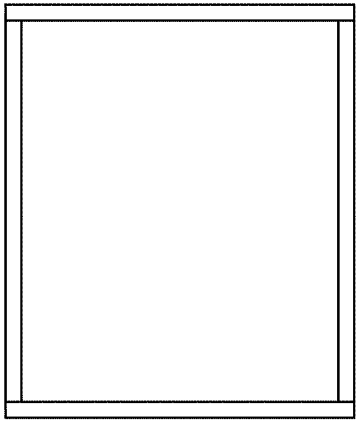
FIGS. 11A and 11B show a top and side view, respectively, of a storage tank according to various embodiments described herein.
Figure 11B:
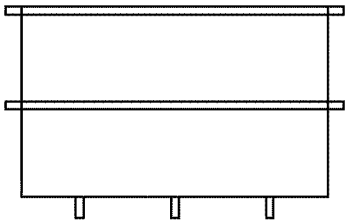

FIGS. 8A and 8B show a strip puller 800 which can be used to pull the workpiece through the process line. The strip puller may include a plurality of rollers 810 which work to pull the workpiece through the process line. Any suitable number of rollers 810 can be used. In some embodiments, one of the rollers 810 can be a collection roller around which the processed workpiece is wound for storage. The rollers 810 can be positioned on top of a table 820 as shown in FIGS. 8A and 8B. As also shown in FIGS. 8A and 8B, the strip puller 800 can include a cathode brush assembly 120 for guiding the workpiece towards the rollers 810 and applying a current to the workpiece. The strip puller 800 can be used to adjust the speed at which the workpiece is pulled through the process line.

Figure 10A:
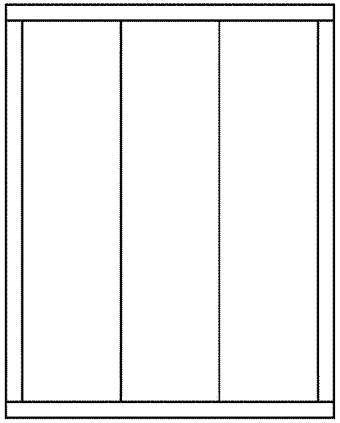
FIGS. 10A and 10B show a top and side view, respectively, of a storage tank according to various embodiments described herein.
Figure 10B:
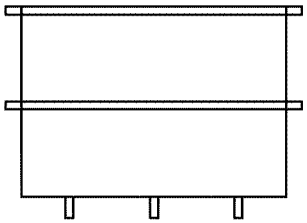
Figure 9A:
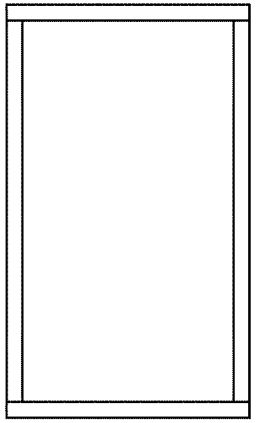
FIGS. 9A and 9B show a top and side view, respectively, of a storage tank according to various embodiments described herein.
Figure 9B:
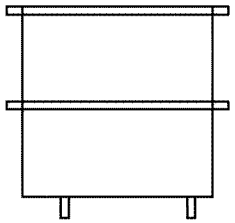
Figure 13A:
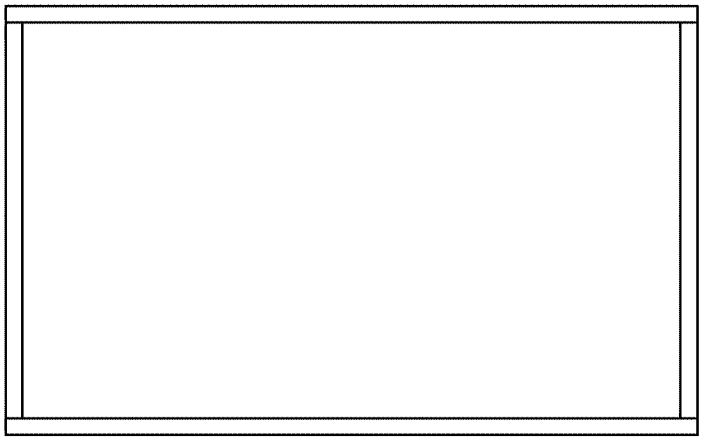
FIGS. 13A and 13B show a top and side view, respectively, of a storage tank according to various embodiments described herein.
Figure 13B:
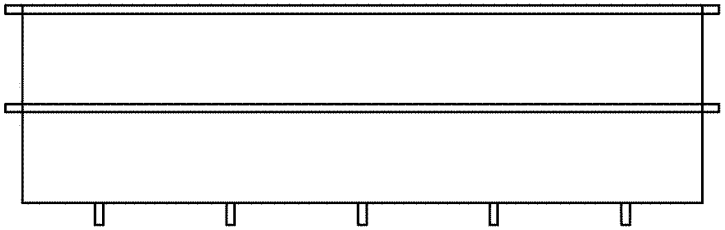
Figure 12A:
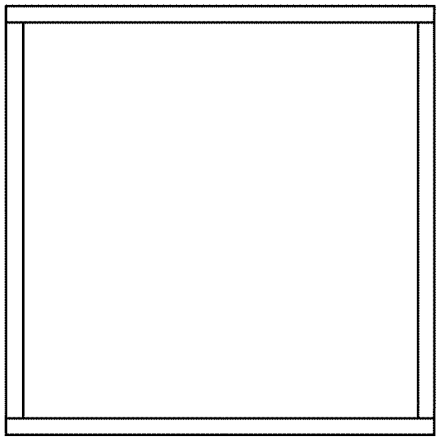
FIGS. 12A and 12B show a top and side view, respectively, of a storage tank according to various embodiments described herein.
Figure 12B:
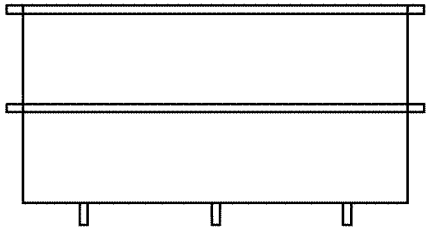

FIGS. 9A, 9B, 10A, 10B, 11A, 11B, 12A, 12B, 13A, and 13B illustrate top and side views of various holding tanks suitable for use in the process line disclosed herein. The tanks are capable of holding a variety of process solutions, and will generally be made of various materials suitable for containing whatever type of process solution is to be held within the tank. Each tank may optionally include a cover where necessary. In some embodiments, the tanks may include partitions, such as shown in FIG. 10A.

Figure 14:
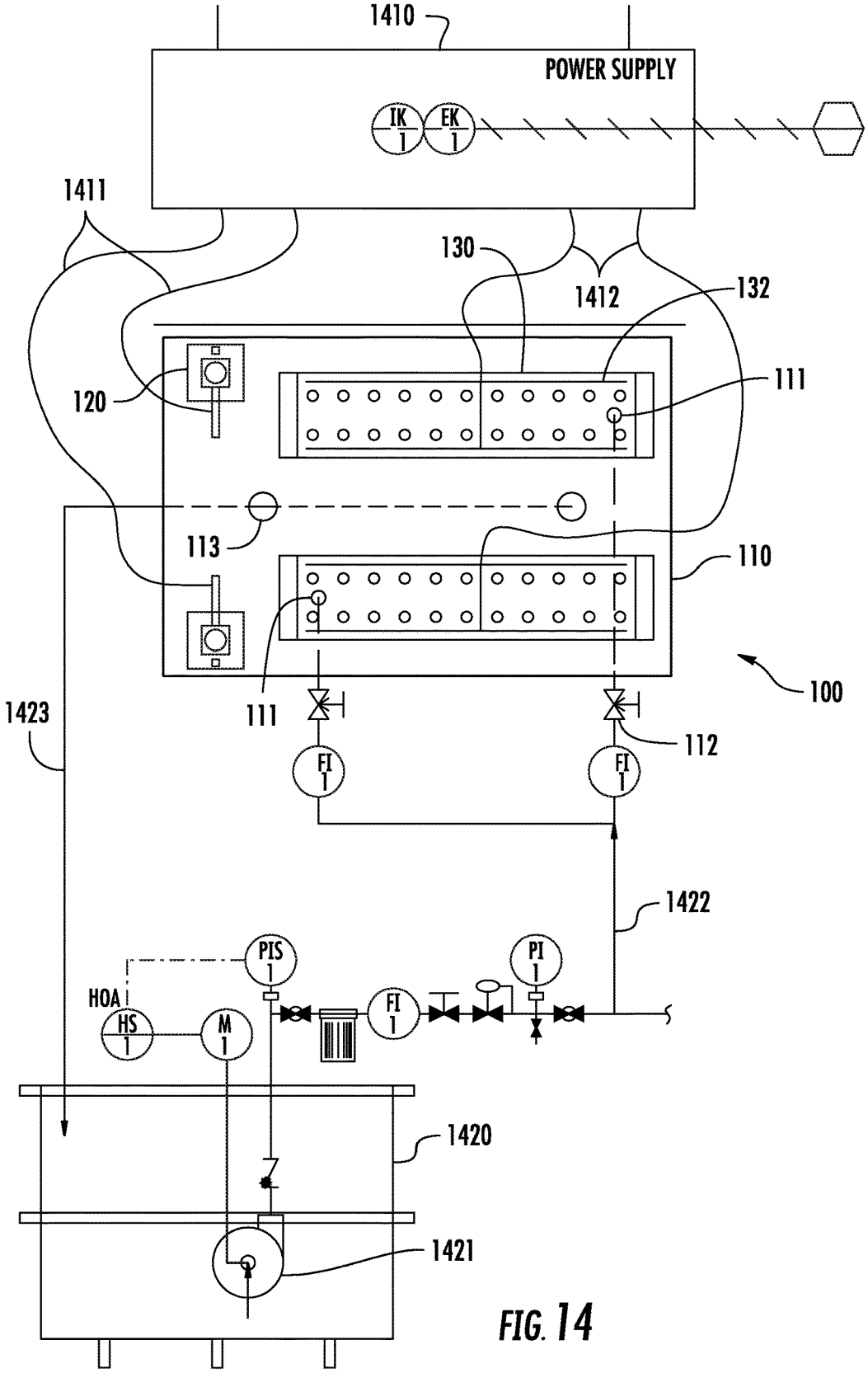
FIG. 14 shows a piping and instrumentation configuration for a plating cell according to various embodiments described herein.

FIG. 14 shows an exemplary piping and instrumentation configuration for a plating cell 100. The plating cell 100 is similar or identical to the plating cell shown in FIGS. 1A and 1B, including an enclosure 110, a cathode brush assembly 120, and an anode assembly 130 having an anode 132. The configuration includes a power supply 1410 and a holding tank 1420.

The holding tank 1420 is used to hold a supply of electrolyte solution. The holding tank 1420 further includes a pump 1421 and an input line 1422. The pump 1421 is used to pump electrolyte solution to the anode assembly 130 via line 1422. Line 1422 can be split one or more times so that a supply of electrolyte solution is provided to each inlet 111 (e.g., as in the case of the two inlets 111 shown in FIG. 14). The flow of the electrolyte solution from the holding tank 1420 into the anode assembly 130 can be controlled via the flow control valves 112. As shown in FIG. 14, the input line 1422 can also include various flow meters, pressure meters, and valves as desired. An outlet line 1423 can also be provided in order to return electrolyte solution back to the holding tank 1420. The outlet line 1423 fluidly connects the drains 113 in the enclosure 110 to the holding tank 1420.

The power supply 1410 is connected to each of the cathode brush assemblies 120 and anodes 132 located in the plating cell 100. A line 1411 connects a negative terminal of the power supply to the cathode brush assembly 120. A line 1412 connects a positive terminal to the anode 132.

Figure 15:
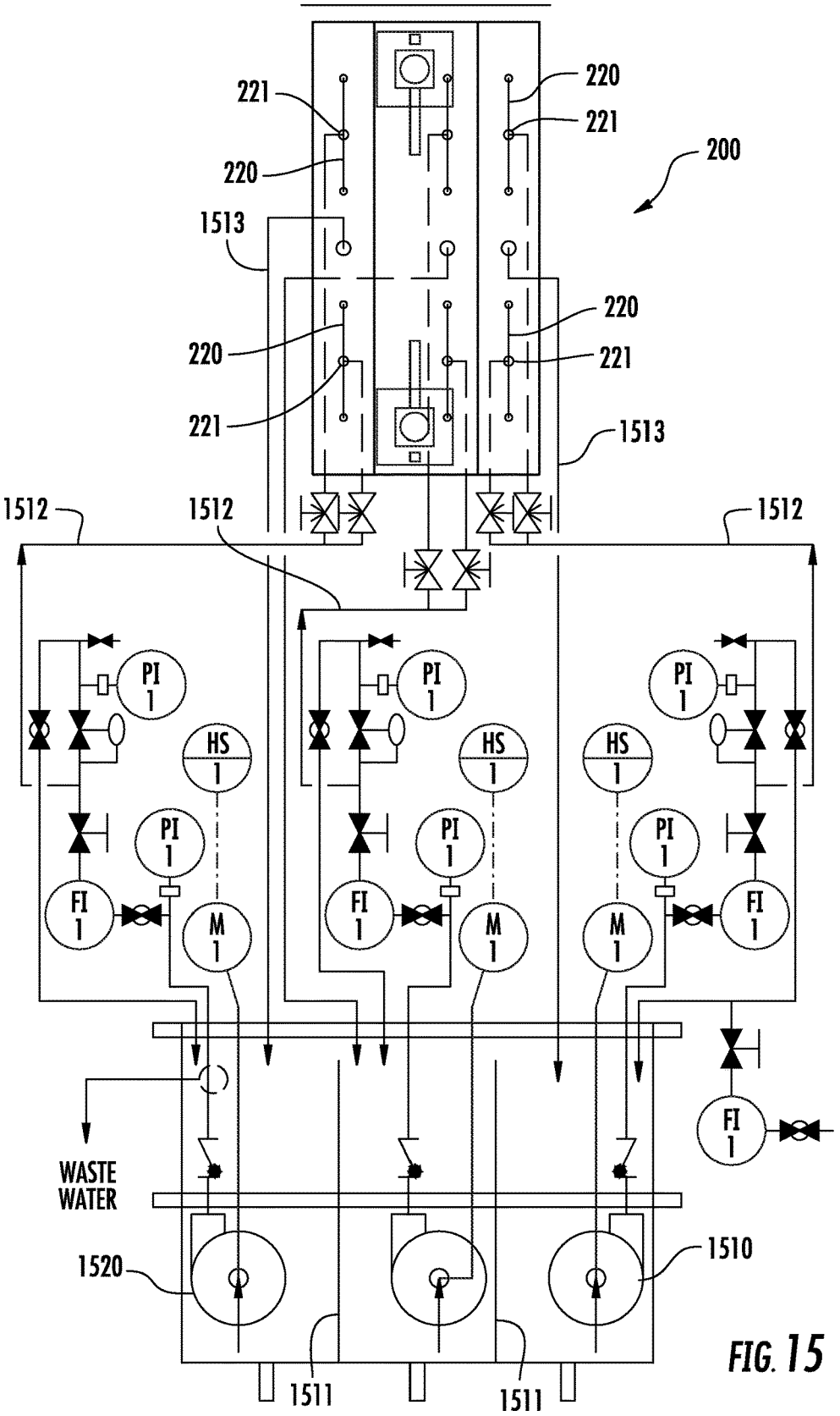
FIG. 15 shows a piping and instrumentation configuration for a triple countercurrent rinse unit according to various embodiments described herein.

FIG. 15 shows an exemplary piping and instrumentation configuration for a three stage rinsing unit 200. The rinsing unit 200 can be similar or identical to the rinse unit 200 shown in FIGS. 2A and 2B. The configuration includes a holding tank 1510 that includes two partitions 1511 to provide three separate holding areas within the holding tank 1510. A pump 1520 is provided in each area so that the process solution in each area can be pumped to the rinse unit. In some embodiments, the rinse unit 200 uses three separate process solutions, thus making the configuration shown in FIG. 15 well adapted for the three stage rinse unit 200. A line 1512 connects each area to an inlet 221 in the rinse unit 200. Each inlet 221 is associated with a spreader pipe 220. The line 1512 can be split in order to provide process solution to each inlet 221 within a stage of the rinse unit 200, and each line 1512 can include a flow control valve 222 in order to control the flow of rinse solution into the rinse unit 200. As shown in FIG. 15, the input lines 1511 can also include various flow meters, pressure meters, and valves as desired.

Outlet lines 1513 can also be provided to allow for the return of process solution back to the holding tank 1510. The outlet lines 1513 are in fluid communication with the drains 230 of the rinse unit.

Figure 16:
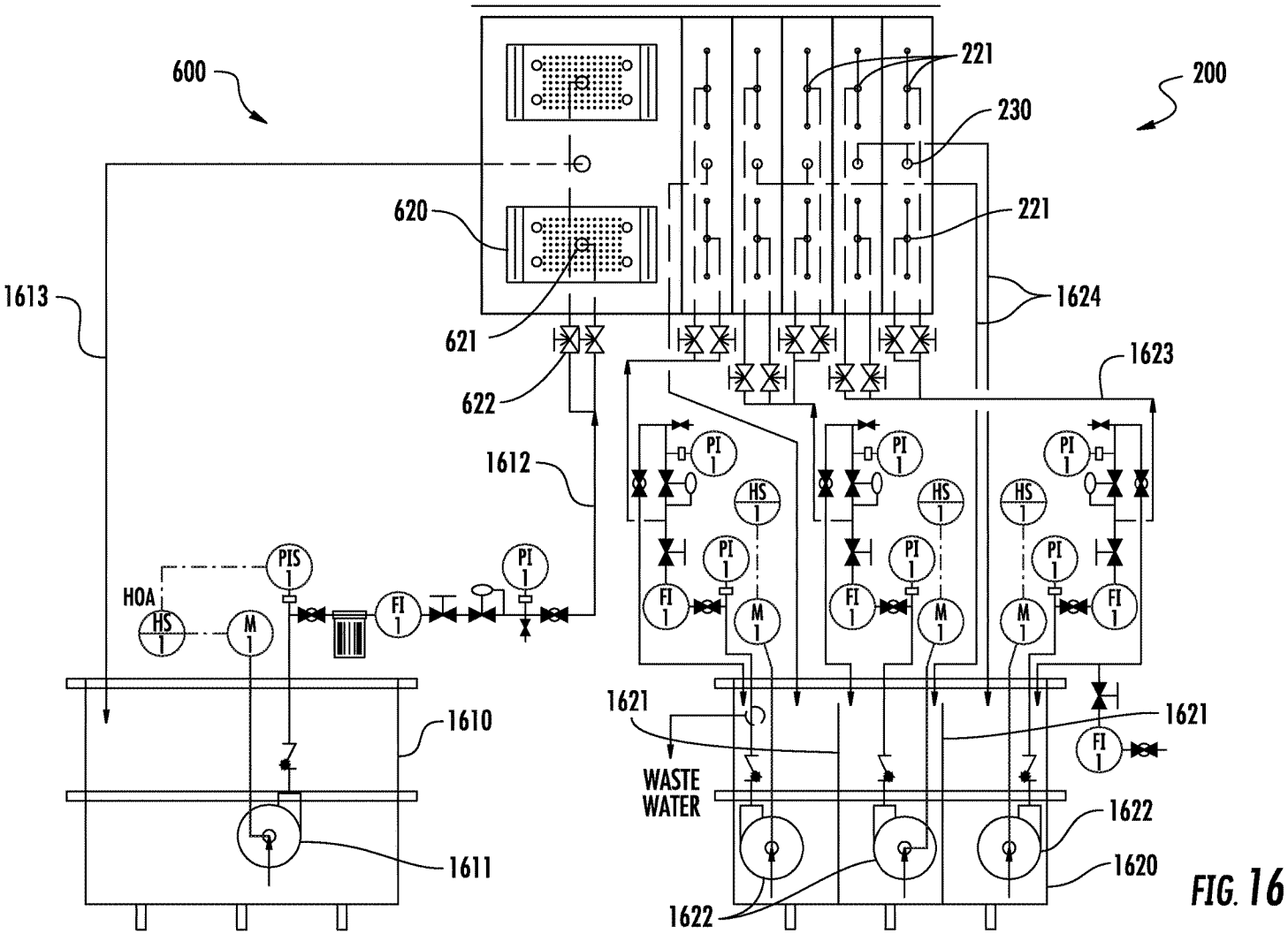
FIG. 16 shows a piping and instrumentation configuration for an immersion cell according to various embodiments described herein.

With reference to FIG. 16, an exemplary piping and instrumentation configuration for an immersion unit 600 and a five stage rinsing unit 200 is shown. The immersion unit 600 and five stage rinsing unit 200 are similar or identical to those shown in FIGS. 6A and 6B. The configuration includes two holding tanks 1610 and 1620. Holding tank 1610 holds process fluid for use in the immersion unit 600 and holding tank 1620 holds process fluid for the five stage rinse unit 200.

Holding tank 1610 includes a pump 1611 for pumping process fluid from the holding tank 1610 to the immersion unit 600. An inlet line 1612 extends between the pump 1611 and the inlet 621 in the immersion vessel 620. The line 1612 may be split into two more lines to feed multiple inlets 621. As shown in FIG. 16, the line 1612 splits once so that two lines can fluidly connect with the inlet 621 in each of the two immersion vessels 620. The line 1612 can further include flow control valves 622 to control the flow of process fluid into the immersion vessels 620. The line 1612 can include various flow meters, pressure meters, and valves as desired.

An outlet line 1613 can also be provided to allow for the return of process solution back to the holding tank 1610. The outlet line 1613 is in fluid communication with the drain 611 of the enclosure 610.

Holding tank 1620 is similar to holding tank 1510 shown in FIG. 15. The holding tank includes two partitions 1621 to separate the holding tank 1620 into three separate holding areas. Each area includes a pump 1622 used for pumping process fluid from the holding tank to a stage of the rinse unit 200. Each pump 1622 is in fluid communication with an inlet line 1623 that terminates at the inlets 221 of the rinse unit 200. Each line 1623 can be split to service both different inlets 221 within a single stage and inlets in different stages of the rinse unit 200. For example, as shown in FIG. 15, an inlet line 1623 splits into four different lines so that two inlets 221 in one rinse stage and two inlets 221 in another, adjacent stage can be supplied by the one line 1623. Each line servicing an inlet 221 can include a flow control valve 222 for controlling the flow of process solution to the inlet. Each line 1623 can include various flow meters, pressure meters, and valves as desired.

Outlet lines 1624 can also be provided to allow for the return of process solution back to the holding tank 1620. The outlet line 1624 is in fluid communication with the drain 230 of the rinse unit 200. Where two or more stages are supplied with the same process solution via inlet line 1623, the outlet lines 1624 are arranged so that the drained process solution from adjacent stages using the same process solution are returned to the appropriate partitioned area of the holding tank 1620.

Figure 17:
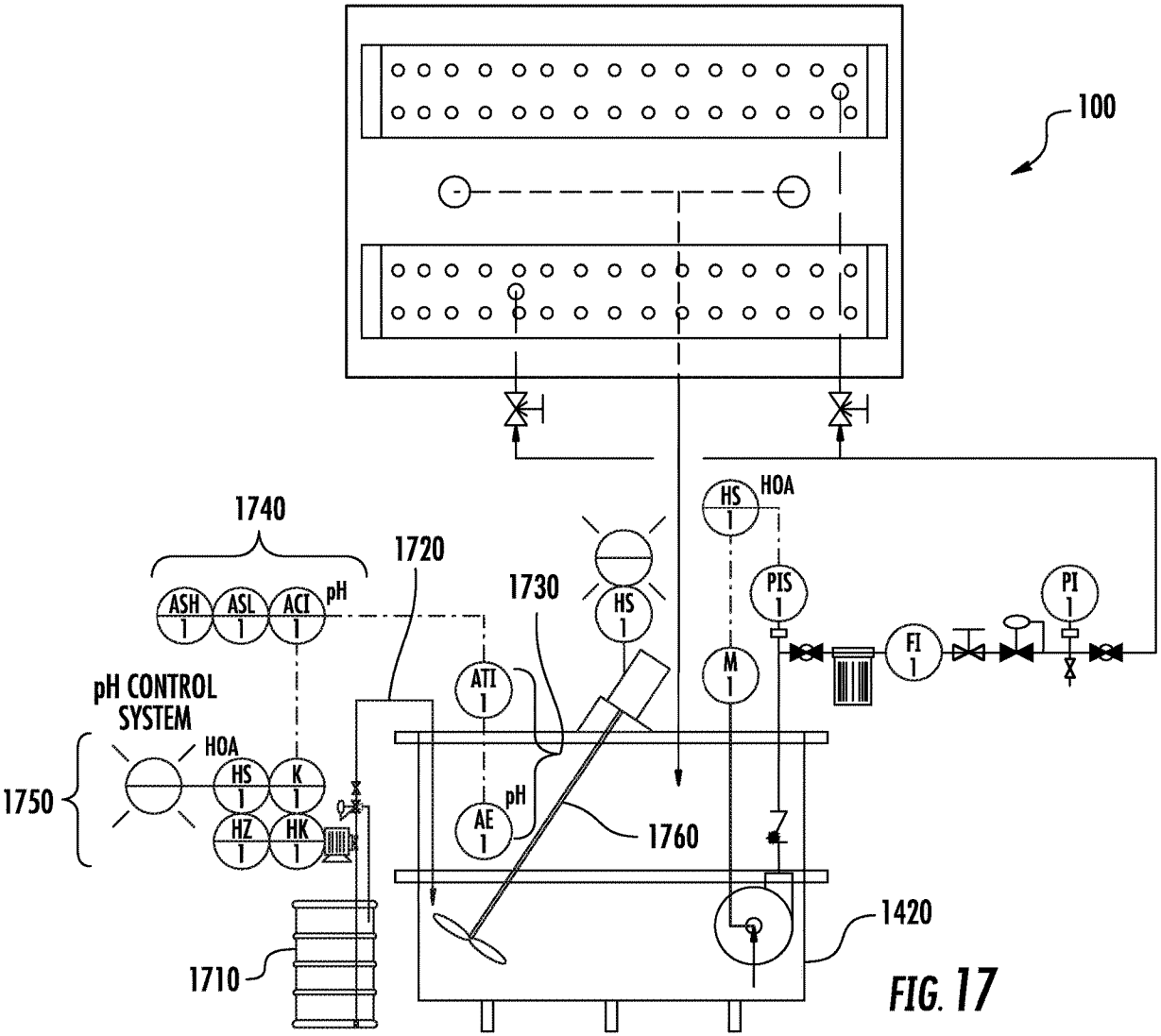
FIG. 17 shows a piping and instrumentation configuration for a chromate coating cell according to various embodiments described herein.

FIG. 17 shows an exemplary piping and instrumentation configuration for a pH control system suitable for use in controlling the pH of the electrolyte solution used in a plating cell. The piping and instrumentation used to deliver electrolyte solution from the tank 1420 to the plating cell is similar or identical to the piping and instrumentation shown in FIG. 14. The tank 1420 further includes tank 1710 filled with process solution suitable for adjusting the pH of the electrolyte solution as needed. An inlet line 1720 is provided from the tank 1710 to the tank 1420 so that process solution for adjusting the pH of the electrolyte solution can be delivered to the tank 1420 as needed. Instrumentation 1730 used to monitor the pH of the electrolyte solution is provided in the tank 1420. This instrumentation 1730 is capable of sending readings to control system 1740, which receives the pH readings and analyzes the information to determine if pH control is required. Where pH control is required, the control system 1740 sends a signal to instrumentation 1750 associated with tank 1710. This information is received and processed by instrumentation 1750, with the result being a desired amount of pH control process solution being sent to the tank 1420.

In some embodiments, the tank 1420 may further include a mixer 1760 for mixing pH control process solution introduced into the tank with the electrolyte solution. In some embodiments, the mixing blade of the mixer 1760 may be located proximate the location where pH control process solution is introduced into the tank 1420.

Figure 18A:
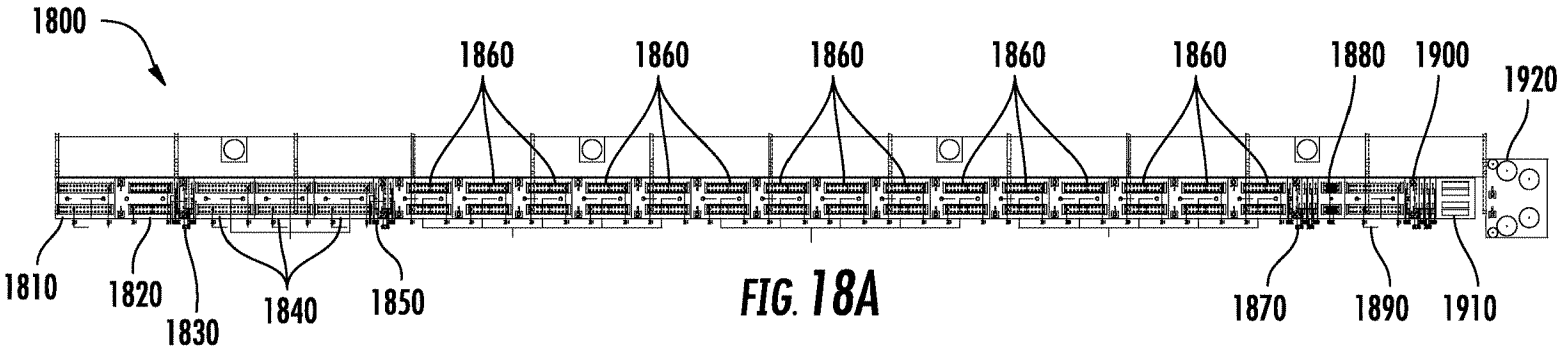
FIGS. 18A and 18B show top and side views, respectively, of a continuous nanolaminate coating process line including 15 plating cells according to various embodiments described herein.
Figure 18B:
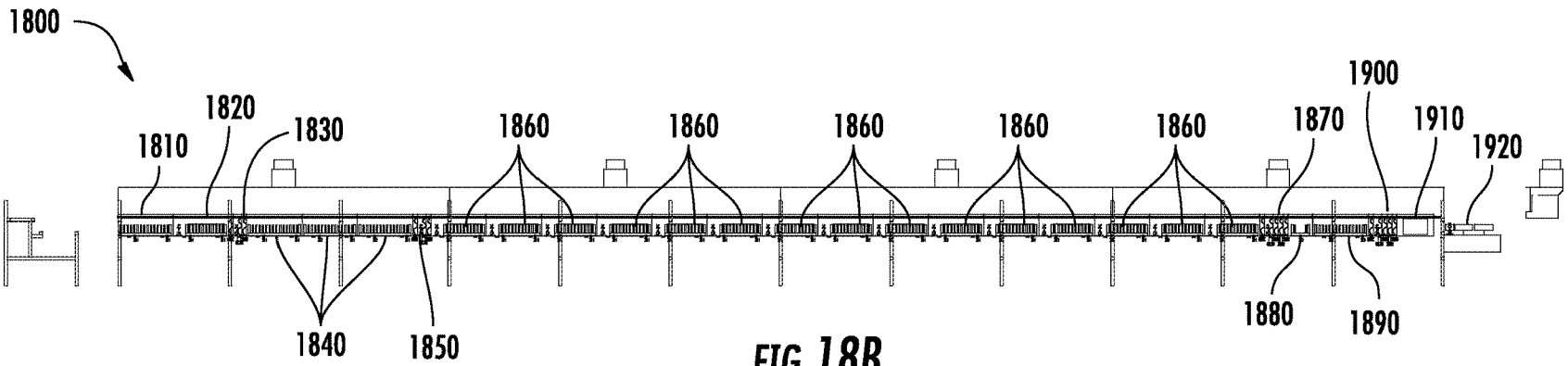

FIGS. 18A and 18B illustrate an embodiment of a process line wherein a combination of various units disclosed herein are combined to carry out the electrodeposition of nanolaminate layers on a workpiece. In the process line shown in FIGS. 18A and 18B, the workpiece enters the process line on the left and exits the process on the right.

The process line may begin with one or more preprocessing units which aim to put the workpiece in better condition for the electrodeposition process. In some embodiments, the first unit in the process line 1800 is an alkaline cleaner unit 1810. The alkaline cleaner unit 1810 is similar to the plating cell shown in FIGS. 1A and 1B. The alkaline unit 1810 does not include a cathode brush assembly or anode. Instead, the anode assembly is filled with the alkaline cleaner and the workpiece is passed through the anode assembly to carry out a cleaning step.

Next, the process line includes an electro-cleaner unit 1820. The electro-cleaner unit 1820 is similar to the plating cell shown in FIGS. 1A and 1B. In this case and as shown in FIGS. 18A and 18B, the electro-cleaner unit 1820 includes the cathode brush assembly and the anode in the anode assembly so that electropolishing can be carried out on the workpiece to remove undesired material from the workpiece surface (e.g., material that may inhibit subsequent electrodeposition). Accordingly, a power source is provided for the electro-cleaner unit 1820 so that the workpiece (via the cathode brush assembly) and anode can be appropriately charged.

Following the electro-cleaner unit 1820, a rinse unit 1830 is provided. As shown in FIGS. 18A and 18B, the rinse unit 1830 includes three stages, although fewer or more stages can be used. Any rinse solution suitable for removing process solution used in the alkaline cleaner unit 1810 and the electro-cleaner unit 1820 can be used in the rinse unit 1830. As also shown in FIGS. 18A and 18B, the rinse unit 1830 may include a cathode brush assembly to help guide the workpiece through the rinse unit 1830 and provide a current to the workpiece as necessary. Accordingly, a power source may be provided for supplying a voltage to the cathode brush assembly in the rinse unit 1830.

Following the rinse unit 1830, a series of three acid activator units 1840 are provided. Three acid activator units 1840 are shown, but fewer or more acid activator units may be used as necessary. The acid activator units 1840 are similar to the alkaline cleaner unit 1810 in that the unit resembles the plating cell shown in FIGS. 1A and 1B, but with the anode and cathode brush assembly removed. The workpiece passes through the anode assembly in each acid activator 1840, which is filled with the process solution used for acid activation. Any material that is suitable for acid activation of the workpiece can be used in the acid activator cells 1840.

Following the acid activator units 1840, another rinse unit 1850 is provided. As shown in FIGS. 18A and 18B, the rinse unit 1850 includes three stages, although fewer or more stages can be used. Any rinse solution suitable for removing process solution used in the acid activation units 1840 can be used in the rinse unit 1850. As also shown in FIGS. 18A and 18B, the rinse unit 1850 may include a cathode brush assembly to help guide the workpiece through the rinse unit 1850 and provide a current to the workpiece as necessary. Accordingly, a power source may be provided for supplying a voltage to the cathode brush assembly in the rinse unit 1850.

Following the rinse unit 1850, the workpiece passes through a plurality of plating cells 1860. As shown in FIGS. 18A and 18B, the process line includes 15 sequential plating cells through which the workpiece passes, although fewer or more plating cells can be used. Each plating cell is similar or identical to the plating cell shown in FIGS. 1A and 1B.

Significantly, each plating cell 1860 may be operated independent of the other plating cells 1860. Each plating cell may include its own power source which may be operated using different parameters than in other plating cells 1860 included in the process line 1800. Each plating cell may include a different electrolyte solution. Each plating cell may use a different distance between the anode and the workpiece. Any other variable process parameter in the plating cell may be adjusted from one plating cell to another. In this manner, the process line may be used to carry out a variety of different coating procedures, including depositing coatings of different materials and thicknesses on the workpiece.

The various power supplies used for the plating cells may control the current density in a variety of ways including applying two or more, three or more or four or more different average current densities to the workpiece as it moves through the plating cell. In one embodiment, the power supply can control the current density in a time varying manner that includes applying an offset current, so that the workpiece remains cathodic when it is moved through the plating cell and the electrode remains anodic even though the potential between the workpiece and the electrode varies. In another embodiment, the power supply varies the current density in a time varying manner which comprises varying one or more of: the maximum current, baseline current, minimum current, frequency, pulse current modulation and reverse pulse current modulation.

Following the plating cells 1860, the process line 1800 may include a rinse unit 1870. The rinse unit 1870 shown in FIGS. 18A and 18B includes five stages (although fewer or more stages can be used). The rinse unit 1870 may be similar or identical to the rinse unit shown in FIGS. 4A, 4B, and 16. The rinse unit 1870 may be configured to deliver one or more different process solutions that are suitable for rinsing the workpiece of the process solutions use in the plating cells. In some embodiments, the first stage of the rinse unit provides a first rinse solution, the second and third stages provide a second rinse solution, and the fourth and fifth solutions provide a third rinse solution. The rinse unit 1870 may also include a cathode brush assembly.

Following the rinse unit 1870, the process line 1800 may include various post processing units. In some embodiments, the rinse unit 1870 is followed by an acid activation unit 1880. The acid activation unit may be similar or identical to the immersion unit 600 shown in FIGS. 6A, 6B, and 16. The acid activation unit 1880 includes an immersion vessel which is filled with process solution for carrying out acid activation. Any material suitable for carrying out acid activation on the work piece can be used. The workpiece passes through the immersion vessel, which prepares the workpiece for subsequent post processing steps.

Following the acid activation unit 1880, the process line 1800 may include a chromate coating unit 1890. The chromate coating unit 1890 may be similar to the acid activators 1840 used in the preprocessing portion of the process line 1800. The chromate coating unit 1890 is therefore similar to the plating cell shown in FIGS. 1A and 1B, but without the anode or cathode brush assembly. The anode assembly is filled with process solution for carrying out a chromate coating step, and the workpiece is passed through the anode assembly to expose the workpiece to the process solution.

Following the chromate coating unit 1890, the process line may include a rinse unit 1900. The rinse unit 1900 may be similar or identical to the rinse unit 1870, including the use of five stages and multiple rinse solutions. In the rinse unit 1900, the rinse solutions can be any rinse solutions suitable for rinsing the workpiece of process solutions used in the acid activation unit 1880 and the chromate coating unit 1890. The rinse unit 1900 may include a cathode brush assembly to guide the workpiece and to provide a voltage if necessary/desired.

Following the rinse unit 1900, the process line 1800 may include a forced air dryer 1910. The forced air dryer 1910 may be similar or identical to the forced air dryer shown in FIGS. 7A and 7B. The forced air dryer 1910 is used to dry the workpiece of the rinse solutions used in the rinse unit 1900.

The workpiece may be moved through the process line 1800 using a strip puller 1920 provided at the end of the process line 1800. The strip puller 1920 may be similar or identical to the strip puller shown in FIGS. 8A and 8B. The strip puller 1920 may serve as a rate control mechanism which can adjust the speed at which the workpiece is pulled through the process line.

2.2 Alternate Electrodeposition Apparatus

Figure 19:
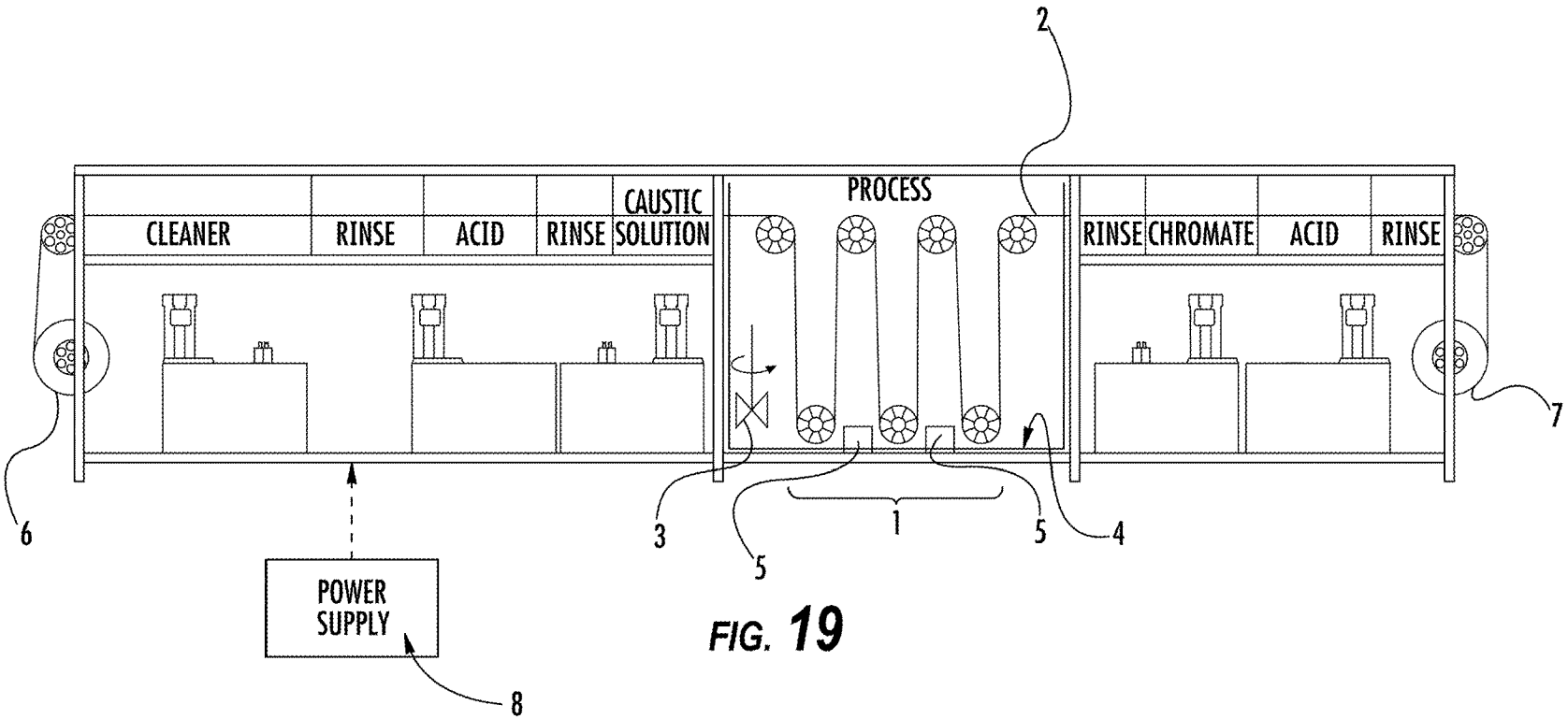
FIG. 19 shows a continuous processing apparatus for the application of nanolaminated coatings configured for conductive materials that can be rolled.

The continuous application of nanolaminate coatings on conductive materials can also be accomplished using an electrodeposition apparatus as shown in FIG. 19. The electrodeposition apparatus can comprise:

- at least a first electrodeposition cell 1 through which a conductive workpiece 2, which serves as an electrode in the cell, is moved at a rate,
- a rate control mechanism that controls the rate the workpiece is moved through the electrodeposition cell;
- an optional mixer for agitating electrolyte during the electrodeposition process (shown schematically in FIG. 19 as item 3);
- a counter electrode 4; and
- a power supply 8 controlling the current density applied to the workpiece in a time varying manner as it moves through the cell.

The rate control mechanism (throughput control mechanism) may be integral to one or more drive motors or the conveying system (e.g., rollers, wheels, pulleys, etc., of the apparatus), or housed in associated control equipment; accordingly, it is not shown in FIG. 1. Similarly the counter electrode may have a variety of configurations including, but not limited to, bars, plates, wires, baskets, rods, conformal anodes and the like, and accordingly is shown generically as a plate 4 at the bottom of the electrodeposition cell 1 in FIG. 19. The counter electrode, which functions as an anode except during reverse pulses, may be inert or may be active, in which case the anode will contain the metal species that is to be deposited and will dissolve into solution during operation.

Power supply 8 may control the current density in a variety of ways including applying two or more, three or more or four or more different average current densities to the workpiece as it moves through the electrodeposition cell(s). In one embodiment the power supply can control the current density in a time varying manner that includes applying an offset current, so that the workpiece remains cathodic when it is moved through the electrodeposition cell and the electrode remains anodic even though the potential between the workpiece and the electrode varies. In another embodiment the power supply varies the current density in a time varying manner which comprises varying one or more of: the maximum current, baseline current, minimum current, frequency, pulse current modulation and reverse pulse current modulation.

The workpiece may be introduced to the electrolyte by immersion in said electrolyte or by spray application of the electrolyte to the workpiece. The application of the electrolyte to the workpiece may be modulated. The rate by which the workpiece is moved through the electrolyte may also be modulated.

Mixing of electrolyte in the electrodeposition cell is provided by solution circulation, a mechanical mixer and/or ultrasonic agitators. While bulk mixing can be provided by the mixer 3, which can be controlled or configured to operate at variable speeds during the electrodeposition process, the apparatus may optionally include one or more ultrasonic agitators which are shown schematically as blocks 5 in the apparatus of FIG. 19. The ultrasonic agitators of the apparatus may be configured to operate independently in a continuous or in a non-continuous fashion (e.g., in a pulsed fashion). In one embodiment the ultrasonic agitators may operate at about 17,000 to 23,000 Hz. In another embodiment they may operate at about 20,000 Hz. Mixing of the electrolyte may also occur in a separate reservoir and the mixed electrolyte may contact the workpiece by immersion or by spray application. Instead of one or more salts of a metal to be electroplated, the electrolyte may comprise two or more, three or more or four or more different salts of electrodepositable metals.

The apparatus may include a location from which the workpiece material is supplied (e.g., a payoff reel) and a location where the coated workpiece is taken up (e.g., a take-up reel, which may be part of a strip puller for conveying a workpiece through the apparatus). Accordingly, the apparatus may comprise a first location 6, from which the workpiece is moved to the electrodeposition cell and/or a second location 7 for receiving the workpiece after it has moved through the electrodeposition cell. Location 6 and location 7 are shown as spindles with reels in FIG. 19, however, they may also consist of racks for storing lengths of materials, folding apparatus, and even enclosures with one or more small openings, from which a workpiece (e.g., a wire, cable, strip or ribbon) is withdrawn or into which a coated workpiece is inserted.

In one embodiment the first and/or second location comprises a spool or a spindle. In such an embodiment the apparatus may be configured to electrodeposit a nanolaminate coating on a continuum of connected parts, wire, rod, sheet or tube that can be wound on the spool or around the spindle.

The apparatus may further comprise an aqueous or a non-aqueous electrolyte. The electrolyte may comprise salts of two or more, three or more or four or more electrodepositable metals.

In addition to the above-mentioned components, the apparatus may comprise one or more locations for treatment of the workpiece prior or subsequent to electrodeposition. In one embodiment the apparatus further includes one or more locations, between the first location and the electrodeposition cell, where the workpiece is contacted with one or more of: a solvent, an acid, a base, an etchant, and/or a rinsing agent to remove the solvent, acid, base, or etchant. In another embodiment the apparatus further includes one or more locations between the electrodeposition cell and a second location, where the coated workpiece is subject to one or more of: cleaning with solvent, cleaning with acid, cleaning with base, passivation treatments and rinsing.

3.0 Electrodeposition Process for the Continuous Application of Nanolaminated Coatings on Workpieces The disclosure provided in this section is equally applicable to the apparatus and methods described in sections 2.1 and 2.2.

3.1 Workpieces

Workpieces may take a variety of forms or shapes. Workpieces may be, for example, in the form of wire, rod, tube, or sheet stock (e.g., rolls or folded sheets). Workpieces may be metal or other conductive strip, sheet or wire. Workpieces may also comprise a series of discrete parts that may be, for example, affixed to a sheet or webbing (e.g., metal netting or flexible screen) so as to form a sheet-like assembly that can be introduced into the electrodeposition cell in the same manner as substantially flat sheets that are to be coated with a nanolaminate by electrodeposition. Workpieces which are a series of discrete parts connected to form a strip must be connected by a conductive connector.

Virtually any material may be used as a workpiece, provided it can be rendered conductive and is not negatively affected by the electrolyte. The materials that may be employed as workpieces include, but are not limited to, metal, conductive polymers (e.g., polymers comprising polyaniline or polypyrrole), or non-conductive polymers rendered conductive by inclusion of conductive materials (e.g., metal powders, carbon black, graphene, graphite, carbon nanotubes, carbon nanofibers, or graphite fibers) or electroless application of a metal coating.

3.2 Continuous Electrodeposition of Nanolaminate Coatings

Nanolaminate coatings may be continuously electrodeposited by a method comprising:

- moving a workpiece through an apparatus comprising one or more electrodeposition cell(s) at a rate, where the electrodeposition cell(s) each comprise an electrode and an electrolyte comprising salts of one or more metals to be electrodeposited; and
- controlling the mixing rate and/or the current density applied to the workpiece in a time varying manner as the workpiece moves through the cell(s), thereby electrodepositing a nanolaminate coating.

By controlling the current density applied to the workpiece in a time varying manner, nanolaminate coatings having layers varying in elemental composition and/or the microstructure of the electrodeposited material can be prepared. In one set of embodiments, controlling the current density in a time varying manner comprises applying two or more, three or more or four or more different current densities to the workpiece as it moves through the electrodeposition cell(s). In another embodiment, controlling the current density in a time varying manner includes applying an offset current, so that the workpiece remains cathodic when it is moved through the electrodeposition cell(s) and the electrode remains anodic, even though the potential between the workpiece and the electrode varies in time to produce nanolamination. In another embodiment controlling the current density in a time varying manner comprises varying one or more of: the baseline current, pulse current modulation and reverse pulse current modulation.

Nanolaminated coatings may also be formed on the workpiece as it passes through the electrodeposition cell(s) by controlling the mixing rate in a time varying manner. In one embodiment, controlling the mixing rate comprises agitating the electrolyte with a mixer (e.g., impeller or pump) at varying rates. In another embodiment, controlling the mixing rate comprises agitating the electrolyte by operating an ultrasonic agitator in a time varying manner (e.g., continuously, non-continuously, with a varying amplitude over time, or in a series of regular pulses of fixed amplitude). In another embodiment, controlling the mixing rate comprises pulsing a spray application of the electrolyte to the workpiece.

In another embodiment, the nanolaminate coatings may be formed by varying both the current density and the mixing rate simultaneously or alternately in the same electrodeposition process.

Regardless of which parameters are varied to induce nanolaminations in the coating applied to the workpiece as it is moved through the electrodeposition cell(s), the rate at which the workpiece passes through the cell(s) represents another parameter that can be controlled. In one embodiment rates that can be employed are in a range of about 1 to about 300 feet per minute. In other embodiments, the rates that can be employed are greater than about 1, 5, 10, 30, 50, 100, 150, 200, 250 or 300 feet per minute, or from about 1 to about 30 feet per minute, about 30 to about 100 feet per minute, about 100 to about 200 feet per minute, about 200 to about 300 feet per minute, or more than about 300 feet per minute. Faster rates will alter the time any portion of the workpiece being plated remains in the electrodeposition cell(s). Accordingly, the rate of mass transfer (rate of electrodeposition) that must be achieved to deposit the same nanolaminate coating thickness varies with the rate the workpiece is moved through the cell(s). In addition, where processes employ variations in current density to achieve nanolamination, the rate the variation in current density occurs must also be increased with an increasing rate of workpiece movement through the electrodeposition cell(s).

In one embodiment, the electrodeposition process may further include a step of moving the workpiece from a first location to the electrodeposition cell or a group of electrodeposition cell(s) (e.g., two or more, three or more, four or more, or five or more electrodeposition cells). In another embodiment, the electrodeposition process may further include a step of moving the workpiece from the electrodeposition cell or a group of electrodeposition cells to a second location for receiving the workpiece after electrodeposition of the nanolaminate coating. In such embodiments, the apparatus may have 1, 2, 3, 4, 5, 6, 7, 8, 9, 10, 11, 12, 13, 14, 15, 16, or more electrodeposition cells that may each have separate power supplies for conducting electrodeposition in their respective cell. As such, the method may further comprise both moving the workpiece from a first location to the electrodeposition cell(s) and moving the workpiece from the electrodeposition cell to the second location.

3.3 Nanolaminate and Fine Grain Coating and Electrolyte Compositions for their Electrodeposition Continuous electrodeposition of nanolaminate coatings can be conducted from either aqueous or non-aqueous electrolytes comprising salts of the metals to be electrodeposited.

In one embodiment, electrodepositing a nanolaminate coating comprises the electrodeposition of a layered composition comprising one or more, two or more, three or more or four or more different elements independently selected from Ag, Al, Au, Be, Co, Cr, Cu, Fe, Hg, In, Mg, Mn, Mo, Nb, Nd, Ni, P, Pd, Pt, Re, Rh, Sb, Sn, Pb, Ta, Ti, W, V, Zn and Zr, wherein each of said independently selected metals is present at greater than about 0.1, about 0.05, about 0.01, about 0.005 or about 0.001% by weight. In one such embodiment, electrodepositing a nanolaminate coating comprises electrodeposition of a layered composition comprising two or more different elements independently selected from Ag, Al, Au, Be, Co, Cr, Cu, Fe, Hg, In, Mg, Mn, Mo, Nb, Nd, Ni, P, Pd, Pt, Re, Rh, Sb, Sn, Pb, Ta, Ti, W, V, Zn and Zr, wherein each of said independently selected metals is present at greater than about 0.005 or about 0.001% by weight. In another such embodiment, electrodepositing a nanolaminate coating comprises the electrodeposition of layers comprising two or more different metals, where the two or more different metals comprise: Zn and Fe, Zn and Ni, Co and Ni, Ni and Fe, Ni and Cr, Ni and Al, Cu and Zn, Cu and Sn, or a composition comprising Al and Ni and Co (AlNiCo). In any of those embodiments the nanolaminate coating may comprise at least one portion consisting of a plurality of layers, wherein each of said layers has a thickness in a range selected independently from: about 5 nm to about 250 nm, from about 5 nm to about 25 nm, from about 10 nm to about 30 nm, from about 30 nm to about 60 nm, from about 40 nm to about 80 nm, from about 75 nm to about 100 nm, from about 100 nm to about 120 nm, from about 120 nm to about 140 nm, from about 140 nm to about 180 nm, from about 180 nm to about 200 nm, from about 200 nm to about 225 nm, from about 220 nm to about 250 nm, or from about 150 nm to about 250 nm.

In another embodiment, the electrodeposited nanolaminate coating compositions comprise a plurality of first layers and second layers that differ in structure or composition. The first layers and second layers may have discrete or diffuse interfaces at the boundary between the layers. In addition, the first and second layers may be arranged as alternating first and second layers.

In embodiments where the electrodeposited nanolaminate coatings comprise a plurality of alternating first layers and second layers, those layers may comprise two or more, three or more, four or more, six or more, eight or more, ten or more, twenty or more, forty or more, fifty or more, 100 or more, 200 or more, 500 or more, 1,000 or more, 1,500 or more, 2,000 or more, 3,000 or more, 5,000 or more or 8,000 or more alternating first and second layers independently selected for each multilayer coating.

In one embodiment each first layer and each second layer comprises, consists essentially of, or consists of two, three, four or more elements independently selected from: Ag, Al, Au, Be, Co, Cr, Cu, Fe, Hg, In, Mg, Mn, Mo, Nb, Nd, Ni, P, Pd, Pt, Re, Rh, Sb, Sn, Pb, Ta, Ti, W, V, Zn and Zr. In another embodiment, each first layer and each second layer comprises, consists essentially of, or consists of two, three, four or more elements independently selected from: Ag, Al, Au, Co, Cr, Cu, Fe, Mg, Mn, Mo, Ni, P, Sb, Sn, Mn, Pb, Ta, Ti, W, V, and Zn. In another embodiment, each first layer and each second layer comprises, consists essentially of, or consists of two, three, four or more elements independently selected from: Al, Au, Co, Cr, Cu, Fe, Mg, Mn, Mo, Ni, P, Sn, Mn, Ti, W, V, and Zn.

In one embodiment each first layer comprises nickel in a range independently selected from about 1% to about 5%, about 5% to about 7%, about 7% to about 10%, about 10% to about 15%, about 15% to about 20%, about 20% to about 30%, about 30% to about 40%, about 40% to about 50%, about 50% to about 55%, about 55% to about 60%, about 60% to about 65%, about 65% to about 70%, about 70% to about 75%, about 75% to about 80%, about 80% to about 85%, about 85% to about 90%, about 90% to about 92%, about 92% to about 93%, about 93% to about 94%, about 94% to about 95%, about 95% to about 96%, about 96% to about 97%, about 97% to about 98% or about 98% to about 99%. In such an embodiment, each second layer may comprise cobalt and/or chromium in a range independently selected from about 1% to about 35%, about 1% to about 3%, about 2% to about 5%, about 5% to about 10%, about 10% to about 15%, about 15% to about 20%, about 20% to about 25%, about 25% to about 30% or about 30% to about 35%.

In one embodiment each first layer comprises nickel in a range independently selected from about 1% to about 5%, about 5% to about 7%, about 7% to about 10%, about 10% to about 15%, about 15% to about 20%, about 20% to about 30%, about 30% to about 40%, about 40% to about 50%, about 50% to about 55%, about 55% to about 60%, about 60% to about 65%, about 65% to about 70%, about 70% to about 75%, about 75% to about 80%, about 80% to about 85%, about 85% to about 90%, about 90% to about 92%, about 92% to about 93%, about 93% to about 94%, about 94% to about 95%, about 95% to about 96%, about 96% to about 97%, about 97% to about 98% or about 98% to about 99%, and the balance of the layer comprises cobalt and/or chromium. In such an embodiment, each second layer may comprise cobalt and/or chromium in a range selected independently from about 1% to about 35%, about 1% to about 3%, about 2% to about 5%, about 5% to about 10%, about 10% to about 15%, about 15% to about 20%, about 20% to about 25%, about 25% to about 30% or about 30% to about 35%, and the balance of the layer comprises nickel. In such embodiments, first and second layers may additionally comprise aluminum.

In one embodiment each first layer comprises nickel in a range independently selected from about 1% to about 5%, about 5% to about 7%, about 7% to about 10%, about 10% to about 15%, about 15% to about 20%, about 20% to about 30%, about 30% to about 40%, about 40% to about 50%, about 50% to about 55%, about 55% to about 60%, about 60% to about 65%, about 65% to about 70%, about 70% to about 75%, about 75% to about 80%, about 80% to about 85%, about 85% to about 90%, about 90% to about 92%, about 92% to about 93%, about 93% to about 94%, about 94% to about 95%, about 95% to about 96%, about 96% to about 97%, about 97% to about 98% or about 98% to about 99%, and the balance of the layer comprises aluminum. In such an embodiment, each second layer may comprise aluminum in a range selected independently from about 1% to about 35%, about 1% to about 3%, about 2% to about 5%, about 5% to about 10%, about 10% to about 15%, about 15% to about 20%, about 20% to about 25%, about 25% to about 30% or about 30% to about 35%, and the balance of the layer comprises nickel.

In one embodiment each first layer comprises nickel in a range independently selected from about 1% to about 5%, about 5% to about 7%, about 7% to about 10%, about 10% to about 15%, about 15% to about 20%, about 20% to about 30%, about 30% to about 40%, about 40% to about 50%, about 50% to about 55%, about 55% to about 60%, about 60% to about 65%, about 65% to about 70%, about 70% to about 75%, about 75% to about 80%, about 80% to about 85%, about 85% to about 90%, about 90% to about 92%, about 92% to about 93%, about 93% to about 94%, about 94% to about 95%, about 95% to about 96%, about 96% to about 97%, about 97% to about 98% or about 98% to about 99%, and the balance of the layer comprises iron. In such an embodiment, each second layer may comprise iron in a range independently selected from about 1% to about 35%, about 1% to about 3%, about 2% to about 5%, about 5% to about 10%, about 10% to about 15%, about 15% to about 20%, about 20% to about 25%, about 25% to about 30% or about 30% to about 35%, and the balance of the layer comprises nickel.

In one embodiment each first layer comprises zinc in a range independently selected from about 1% to about 5%, about 5% to about 7%, about 7% to about 10%, about 10% to about 15%, about 15% to about 20%, about 20% to about 30%, about 30% to about 40%, about 40% to about 50%, about 50% to about 55%, about 55% to about 60%, about 60% to about 65%, about 65% to about 70%, about 70% to about 75%, about 75% to about 80%, about 80% to about 85%, about 85% to about 90%, about 90% to about 92%, about 92% to about 93%, about 93% to about 94%, about 94% to about 95%, about 95% to about 96%, about 96% to about 97%, about 97% to about 98%, about 98% to about 99%, about 99% to about 99.5%, about 99.2% to about 99.7%, or about 99.5% to about 99.99%, and the balance of the layer comprises iron. In such an embodiment, each second layer may comprise iron in a range independently selected from about 0.01% to about 35%, about 0.01% to about 0.5%, about 0.3% to about 0.8%, about 0.5% to about 1.0%, about 1% to about 3%, about 2% to about 5%, about 5% to about 10%, about 10% to about 15%, about 15% to about 20%, about 20% to about 25%, about 25% to about 30% or about 30% to about 35%, and the balance of the layer comprises zinc.

In any of the foregoing embodiments the first and/or second layers may each comprise one or more, two or more, three or more, or four or more elements selected independently for each first and second layer from the group consisting of Ag, Al, Au, Be, Co, Cr, Cu, Fe, Hg, In, Mg, Mn, Mo, Nb, Nd, Ni, P, Pd, Pt, Re, Rh, Sb, Sn, Pb, Ta, Ti, W, V, Zn and Zr.

In one embodiment, electrodepositing a "fine-grained" or "ultrafine-grained" metal comprises electrodepositing a metal or metal alloy having an average grain size from 1 nm to 5,000 nm (e.g., 1-20, 1-100, 5-50, 5-100, 5-200, 10-100, 10-200, 20-200, 20-250, 20-500, 50-250, 50-500, 100-500, 200-1,000, 500-2,000, or 1,000-5,000 nm based on the measurement of grain size in micrographs). In such embodiments, the fine-grained metal or alloy may comprise one or more, two or more, three or more, or four or more elements selected independently from the group consisting of Ag, Al, Au, Be, Co, Cr, Cu, Fe, Hg, In, Mg, Mn, Mo, Nb, Nd, Ni, P, Pd, Pt, Re, Rh, Sb, Sn, Pb, Ta, Ti, W, V, Zn and Zr. Fine-grained metals and alloys, including those comprising a high degree of twinning between metal grains, may remain ductile while having one or more properties including increased hardness, tensile strength, and corrosion resistance relative to electrodeposited metals or alloys of the same composition with a grain size from 5,000 to 20,000 nm or greater.

In one embodiment, the coefficient of thermal expansion of the nanolaminate coating layers and/or the fine grain coating layers is within 20% (less than 20%, 15%. 10%, 5%, or 2%) of the workpiece in the direction parallel to workpiece movement (i.e., in the plane of the workpiece and parallel to the direction of workpiece movement).

3.4 Pre- and Post-Electrodeposition Treatments

Prior to electrodeposition, or following electrodeposition, methods of continuously electrodepositing a nanolaminate coating may include further steps of pre-electrodeposition or post-electrodeposition treatment.

Accordingly, the apparatus described above may further comprise one or more locations between the first location and the electrodeposition cell(s), and the method may further comprise contacting the workpiece with one or more of: a solvent, an acid, a base, an etchant, or a rinsing solution (e.g., water) to remove said solvent, acid, base, or etchant. In addition, the apparatus described above may further comprise one or more locations between the electrodeposition cell(s) and a second location, and the method may further comprise contacting the workpiece with one or more of: a solvent, an acid, a base, a passivation agent, or a rinse solution (e.g., water) to remove the solvent, acid, base or passivation agent.

4.0 Nanolaminated Articles Prepared by Continuous Electrodeposition

The disclosure provided in this section is equally applicable to the apparatus and methods described in sections 2.1 and 2.2

The process and apparatus described herein may be adapted for the preparation of articles comprising, consisting essentially of, or consisting of nanolaminated materials by the use of a workpiece to which the coating applied during electrodeposition does not adhere tightly. The article may be obtained after removal of the workpiece from the electrodeposition process by separating the coating from the workpiece. In addition, where the workpiece is not flat, 3-dimensional articles may be formed as reliefs on the contoured surface of the workpiece.

5.0 Certain Embodiments

1. An apparatus for electrodepositing a nanolaminate coating comprising:

at least a first electrodeposition cell and a second electrodeposition cell (e.g., two, three, four, five, six, seven, eight, nine, ten, eleven, twelve, thirteen, fourteen fifteen, sixteen or more electrodeposition cells) through which a conductive workpiece is moved at a rate, each electrodeposition cell containing an electrode (e.g., an anode); and a rate control mechanism that controls the rate the workpiece is moved through the electrodeposition cell(s); wherein each electrodeposition cell optionally comprises a mixer for agitating an electrolyte in its respective electrodeposition cell during the electrodeposition process;

wherein each electrodeposition cell optionally comprises a flow control unit for applying an electrolyte to the workpiece; and wherein each electrodeposition cell has a power supply (e.g., a power supply for each cell or groups of cells comprising two, three, four, five, six, seven, eight, nine, ten, eleven, twelve, thirteen, fourteen or fifteen cells) controlling the current density and/or voltage applied to the workpiece in a time varying manner as it moves through each electrodeposition cell.

2. The apparatus of embodiment 1, wherein controlling the current density in a time varying manner comprises applying two or more, three or more or four or more different current densities to the workpiece as it moves through at least one electrodeposition cell (e.g., two or more, three or more, four or more, five or more, or each electrodeposition cell).

3. The apparatus of embodiment 2, wherein controlling the current density in a time varying manner comprises applying an offset current, so that the workpiece remains cathodic when it is moved through at least one electrodeposition cell (e.g., one or more, two or more, three or more, four or more, five or more, or each electrodeposition cell) and the electrode remains anodic.

4. The apparatus of any of embodiments 1 or 2, wherein the time varying manner comprises one or more of: varying the baseline current, pulse current modulation and reverse pulse current modulation.

5. The apparatus of any of the preceding embodiments, wherein one or more of the electrodeposition cells further comprises an ultrasonic agitator.

6. The apparatus of embodiment 5, wherein each ultrasonic agitator independently operates continuously or in a pulsed fashion.

7. The apparatus of any of the preceding embodiments, wherein at least one electrodeposition cell (e.g., one or more, two or more, three or more, four or more, five or more, or each electrodeposition cell) comprises a mixer that operates independently to variably mix an electrolyte placed in its respective electrodeposition cell(s).

8. The apparatus of any of the preceding embodiments, further comprising a first location, from which the workpiece is moved to the electrodeposition cells, and/or a second location, for receiving the workpiece after it has moved through one or more of the electrodeposition cells.

9. The apparatus of embodiment 8, wherein the first and/or second location comprises a spool or a spindle.

10. The apparatus of embodiment 9, wherein the workpiece is a wire, rod, sheet, chain, strand, or tube that can be wound on said spool or around said spindle.

11. The apparatus of any of the preceding embodiments, wherein any one or more of said electrodeposition cell(s) (e.g., one or more, two or more, three or more, four or more, five or more, or each electrodeposition cell) comprises (contains) an aqueous electrolyte.

12. The apparatus of any of embodiments 1-10, wherein any one or more of said electrodeposition cell(s) (e.g., one or more, two or more, three or more, four or more, five or more, or each electrodeposition cell) comprises (contains) a non-aqueous electrolyte.

13. The apparatus of any preceding embodiment, wherein each electrolytes comprises salts of two or more, three or more or four or more electrodepositable metals, which are selected independently for each electrolyte.

14. The apparatus of any of the preceding embodiments further comprising one or more locations between the first location and the electrodeposition cells, where the workpiece is contacted with one or more of: a solvent, an acid, a base, an etchant, and a rinsing agent to remove said solvent, acid, base, or etchant.

15. The apparatus of any of the preceding embodiments further comprising one or more locations between the electrodeposition cells and said second location, where the coated workpiece is subject to one or more of: cleaning with solvent, cleaning with acid, cleaning with base, passivation treatments, or rinsing.

16. A method of electrodepositing a nanolaminate coating comprising:

providing an apparatus comprising at least a first electrodeposition cell and a second electrodeposition cell (e.g., two, three, four, five, six, seven, eight, nine, ten, eleven, twelve, thirteen, fourteen, fifteen or more electrodeposition cells);

wherein each electrodeposition cell has a power supply (e.g., a power supply for each cell or groups of cells comprising two, three, four, five, six, seven, eight, nine, ten, eleven, twelve, thirteen, fourteen or fifteen cells) controlling the current density applied to the workpiece in a time varying manner as it moves through each electrodeposition cell;

where each electrodeposition cell comprises an electrode and an electrolyte comprising salts of two or more, three or more, or four or more different electrodepositable metals selected independently for each electrolyte; and moving a workpiece through at least the first electrodeposition cell and the second electrodeposition cell of the apparatus at a rate and independently controlling the mixing rate and/or the current density applied to the workpiece in a time varying manner as it moves through each electrodeposition cell, thereby electrodepositing a coating comprising nanolaminate coating layers and/or one or more (e.g., two or more, three or more, four or more, or five or more) fine-grained metal layers.

17. The method of embodiment 16, wherein controlling the current density in a time varying manner comprises applying two or more, three or more, or four or more different current densities to the workpiece as it moves through at least one electrodeposition cell (e.g., two or more, three or more, four or more, or five or more electrodeposition cells).

18. The method of embodiment 16 or 17, wherein controlling the current density in a time varying manner comprises applying an offset current, so that the workpiece remains cathodic when it is moved through at least one electrodeposition cell (e.g., two or more, three or more, four or more, or five or more electrodeposition cells) and the electrode remains anodic.

19. The method of embodiments 16 or 17, wherein the time varying manner comprises one or more of: varying the baseline current, pulse current modulation and reverse pulse current modulation.

20. The method of any of embodiments 16-19, wherein one or more electrodeposition cells comprises a mixer, wherein each mixer is independently operated at a single rate or at varying rates to agitate the electrolyte within its respective electrodeposition cell.

21. The method of any of embodiments 16-20, wherein one or more electrodeposition cells comprises an ultrasonic agitator, wherein each agitator is independently operated continuously or in a non-continuous fashion to control the mixing rate.

22. The method of any of embodiments 16-21, further comprising controlling the rate the workpiece is moved through the electrodeposition cells.

23. The method of any of embodiments 16-22, wherein the apparatus further comprises a first location, from which the workpiece is moved to the first electrodeposition cell and the second electrodeposition cell (e.g., the electrodeposition cells), and/or a second location for receiving the workpiece after it has moved through the first electrodeposition cell and the second electrodeposition cell (e.g., the electrodeposition cells), the method further comprising moving the workpiece from the first location to the first electrodeposition cell and the second electrodeposition cell and/or moving the workpiece from the first electrodeposition cell and the second electrodeposition cell to the second location.

24. The method of embodiment 23, wherein the apparatus further comprises one or more locations between the first location and the electrodeposition cell(s), and the method further comprises contacting the workpiece with one or more of: a solvent, an acid, a base, and an etchant, and rinsing to remove said solvent, acid, base, or etchant at one or more of the locations between the first location and the electrodeposition cell(s).

25. The method of embodiments 23 or 24, wherein the apparatus further comprises one or more locations between the electrodeposition cells and said second location, and the method further comprises contacting the workpiece with one or more of: a solvent, an acid, a base, a passivation agent, and a rinsing agent to remove the solvent, acid, base and/or passivation agent at one or more locations between the electrodeposition cells and said second location.

26. The method of any of embodiments 16-25, wherein said workpiece is comprised of a metal, a conductive polymer or a non-conductive polymer rendered conductive by inclusion of conductive materials or electroless application of a metal.

27. The method of any of embodiments 16-26, wherein the workpiece is a wire, rod, sheet, chain, strand, or tube.

28. The method of any of embodiments 16-27, wherein the electrolytes is/are aqueous electrolyte(s) (e.g., one or more, two or more, or each electrolyte is an aqueous electrolyte).

29. The method of any of embodiments 16-27, wherein the electrolyte(s) is/are a non-aqueous electrolyte(s) (e.g., one or more, two or more, or each electrolyte is a non-aqueous electrolyte).

30. The method of any of embodiments 16-29, wherein electrodepositing a nanolaminate coating or fine grained metal comprises the electrodeposition of a composition comprising one or more, two or more, three or more or four or more different elements independently selected from Ag, Al, Au, Be, Co, Cr, Cu, Fe, Hg, In, Mg, Mn, Mo, Nb, Nd, Ni, P, Pd, Pt, Re, Rh, Sb, Sn, Pb, Ta, Ti, W, V, Zn and Zr, wherein each of said independently selected metals is present at greater than 0.1, 0.05, 0.01, 0.005 or 0.001% by weight.

31. The method of any of embodiments 16-29, wherein electrodepositing a nanolaminate coating or fine grained metal comprises the electrodeposition of a composition comprising two or more different elements independently selected from Ag, Al, Au, Be, Co, Cr, Cu, Fe, Hg, In, Mg, Mn, Mo, Nb, Nd, Ni, P, Pd, Pt, Re, Rh, Sb, Sn, Pb, Ta, Ti, W, V, Zn and Zr, wherein each of said independently selected metals is present at greater than about 0.1, 0.05, 0.01, 0.005 or 0.001% by weight.

32. The method of embodiment 31, wherein said two or more different metals comprise: Zn and Fe, Zn and Ni, Co and Ni, Ni and Fe, Ni and Cr, Ni and Al, Cu and Zn, Cu and Sn, or a composition comprising Al and Ni and Co.

33. The method according to any of embodiments 16-32, wherein the nanolaminate coating comprises at least one portion consisting of a plurality of layers, wherein each of said layers has a thickness in a range selected independently from about 5 nm to about 250 nm, from about 5 nm to about 25 nm, from about 10 nm to about 30 nm, from about 30 nm to about 60 nm, from about 40 nm to about 80 nm, from about 75 nm to about 100 nm, from about 100 nm to about 120 nm, from about 120 nm to about 140 nm, from about 140 nm to about 180 nm, from about 180 nm to about 200 nm, from about 200 nm to about 225 nm, from about 220 nm to about 250 nm, or from about 150 nm to about 250 nm.

34. The method of any of embodiments 16-33, wherein the nanolaminate coating layers comprise a plurality of first layers and second layers that differ in structure or composition, and which may have discrete or diffuse interfaces between the first and second layers.

35. The method of embodiment 34, wherein the first and second layers are arranged as alternating first and second layers.

36. The method of embodiment 35, wherein said plurality of alternating first layers and second layers comprises two or more, three or more, four or more, six or more, eight or more, ten or more, twenty or more, forty or more, fifty or more, 100 or more, 200 or more, 500 or more, 1,000 or more, 1,500 or more, 2,000 or more, 4,000 or more, 6,000 or more, or 8,000 or more alternating first and second layers independently selected for each multilayer coating.

37. The method of any of embodiments 34-36, wherein each first layer comprises nickel in a range independently selected from 1%-5%, 5%-7%, 7%-10%, 10%-15%, 15%-20%, 20%-30%, 30%-40%, 40%-50%, 50%-55%, 55%-60%, 60%-65%, 65%-70%, 70%-75%, 75%-80%, 80%-85%, 85%-90%, 90%-92%, 92%-93%, 93%-94%, 94%-95%, 95%-96%, 96%-97%, 97%-98% or 98%-99%.

38. The method of embodiment 37, wherein each second layer comprises cobalt and/or chromium in a range independently selected from 1%-35%, 1%-3%, 2%-5%, 5%-10%, 10%-15%, 15%-20%, 20%-25%, 25%-30% or 30%-35%.

39. The method of any of embodiments 34-36, wherein each first layer comprises nickel in a range independently selected from 1%-5%, 5%-7%, 7%-10%, 10%-15%, 15%-20%, 20%-30%, 30%-40%, 40%-50%, 50%-55%, 55%-60%, 60%-65%, 65%-70%, 70%-75%, 75%-80%, 80%-85%, 85%-90%, 90%-92%, 92%-93%, 93%-94%, 94%-95%, 95%-96%, 96%-97%, 97%-98% or 98%-99%, and the balance of the layer comprises, consists essentially of, or consists of cobalt and/or chromium.

40. The method of embodiment 39, wherein each second layer comprises cobalt and/or chromium in a range selected independently from 1%-35%, 1%-3%, 2%-5%, 5%-10%, 10%-15%, 15%-20%, 20%-25%, 25%-30% or 30%-35%, and the balance of the layer comprises, consists essentially of, or consists of nickel.

41. The method of any of embodiments 34-36, wherein each first layer comprises nickel in a range independently selected from 1%-5%, 5%-7%, 7%-10%, 10%-15%, 15%-20%, 20%-30%, 30%-40%, 40%-50%, 50%-55%, 55%-60%, 60%-65%, 65%-70%, 70%-75%, 75%-80%, 80%-85%, 85%-90%, 90%-92%, 92%-93%, 93%-94%, 94%-95%, 95%-96%, 96%-97%, 97%-98% or 98%-99%, and the balance of the layer comprises, consists essentially of, or consists of iron.

42. The method of embodiment 41, wherein each second layer comprises iron in a range independently selected from 1%-35%, 1%-3%, 2%-5%, 5%-10%, 10%-15%, 15%-20%, 20%-25%, 25%-30% or 30%-35%, and the balance of the layer comprises, consists essentially of, or consists of nickel.

43. The method of any of embodiments 34-36, wherein each first layer comprises zinc in a range independently selected from 1%-5%, 5%-7%, 7%-10%, 10%-15%, 15%-20%, 20%-30%, 30%-40%, 40%-50%, 50%-55%, 55%-60%, 60%-65%, 65%-70%, 70%-75%, 75%-80%, 80%-85%, 85%-90%, 90%-92%, 92%-93%, 93%-94%, 94%-95%, 95%-96%, 96%-97%, 97%-98%, 98%-99%, 99%-99.5%, 99.2%-99.7%, or 99.5%-99.99%, and the balance of the layer comprises, consists essentially of, or consists of iron.

44. The method of embodiment 43, wherein each second layer comprises iron in a range independently selected from 0.01%-35%, 0.01%-0.5%, 0.3%-0.8%, 0.5%-1.0%, 1%-3%, 2%-5%, 5%-10%, 10%-15%, 15%-20%, 20%-25%, 25%-30% or 30%-35%, and the balance of the layer comprises, consists essentially of, or consists of zinc.

45. The method of any of embodiments 34-36, wherein one or more of said first and/or second layers comprises one or more, two or more, three or more or four or more elements selected independently for each first and second layer from the group consisting of Ag, Al, Au, C, Cr, Cu, Fe, Mg, Mn, Mo, Sb, Si, Sn, Pb, Ta, Ti, W, V, Zn and Zr.

46. A product produced by the method of any of embodiments 16-45.

The invention claimed is:

1. A method of electrodepositing a nanolaminate coating comprising:

providing an electrodeposition cell comprising an anode assembly and a cathode assembly, that are arranged in the electrodeposition cell, the anode assembly comprising a first portion and a second portion that is spaced apart from the first portion; and electrodepositing a first nanolaminate coating on a first surface of a conductive workpiece and a second nanolaminate coating on a second surface of the conductive workpiece, the first and the second nanolaminate coatings each comprising a plurality of nanolaminate layers, each nanolaminate layer of the plurality of nanolaminate layers differing from adjacent nanolaminate layers in structure or composition, the electrodepositing comprising:

moving the conductive workpiece through an electrolyte comprising salts of two or more different electrodepositable metals in the electrodeposition cell by winding the conductive workpiece around a plurality of rollers in a path, the path passing the conductive workpiece between the first portion and the second portion of the anode assembly, the conductive workpiece passing a first distance from the first portion of the anode assembly and a second distance from the second portion of the anode assembly, the second distance being different than the first distance, thereby causing the first nanolaminate coating and the second nanolaminate coating to have different thicknesses; and controlling the current density applied to the conductive workpiece in a time varying manner as it moves through the electrodeposition cell, with a power supply.

2. The method of claim 1, wherein controlling the current density in a time varying manner comprises applying two or more different current densities to the conductive workpiece as it moves through the electrodeposition cell.

3. The method of claim 2, wherein controlling the current density in a time varying manner comprises applying three or more different current densities to the conductive workpiece as it moves through electrodeposition cell.

4. The method of claim 1, wherein controlling the current density in a time varying manner comprises applying an offset current, so that the conductive workpiece remains cathodic when it is moved through the electrodeposition cell and the first and second anode assemblies remain anodic.

5. The method of claim 1, wherein the time varying manner comprises one or more of: varying the baseline current, pulse current modulation and reverse pulse current modulation.

6. The method of claim 1, wherein the electrodeposition cell comprises a mixer; or wherein the electrodeposition cell comprises an ultrasonic agitator.

7. The method of claim 6, wherein the mixer is operated at a single rate to agitate the electrolyte within the electrodeposition cell; or wherein the agitator is operated continuously to control a mixing rate.

8. The method of claim 6, wherein the mixer is operated at a varying rate to agitate the electrolyte within the electrodeposition cell; or wherein the agitator is operated in a non-continuous fashion to control a mixing rate.

9. The method of claim 1, further comprising controlling the rate the conductive workpiece is moved through the electrodeposition cell.

10. The method of claim 1, wherein the conductive workpiece comprises a metal; and wherein the conductive workpiece is a sheet.

11. The method of claim 1, wherein the electrolyte is a non-aqueous electrolyte.

12. The method of claim 1, wherein the nanolaminate coating layers or fine-grained metal layers comprise two or more different elements independently selected from Ag, Al, Au, Be, Co, Cr, Cu, Fe, Hg, In, Mg, Mn, Mo, Nb, Nd, Ni, P, Pd, Pt, Re, Rh, Sb, Sn, Pb, Ta, Ti, W, V, Zn and Zr, wherein each of the elements is present at greater than 0.001% by weight.

13. The method of claim 1, wherein the nanolaminate coating layers or fine-grained metal layers comprise two or more different elements independently selected from Ag, Al, Au, Be, Co, Cr, Cu, Fe, Hg, In, Mg, Mn, Mo, Nb, Nd, Ni, P, Pd, Pt, Re, Rh, Sb, Sn, Pb, Ta, Ti, W, V, Zn and Zr, wherein each of the elements is present at greater than about 0.1, 0.05, 0.01, 0.005 or 0.001% by weight.

14. The method of claim 1, wherein the nanolaminate coating layers comprise a plurality of first layers and second layers that differ in structure or composition, and which have discrete interfaces between the first and second layers.

15. The method of claim 1, wherein the electrolyte comprises salts of three or more different electrodepositable metals.

16. The method of claim 1, wherein the nanolaminate coating layers comprise a plurality of first layers and second layers that differ in structure or composition, and which have diffuse interfaces between the first and second layers.

17. The method of claim 1, wherein said workpiece is comprised of a conductive polymer or a non-conductive polymer rendered conductive by inclusion of conductive materials or electroless application of a metal; and wherein the conductive workpiece is a wire, rod, sheet, chain, strand, or tube.

18. The method of claim 1, wherein the nanolaminate coating layers or fine-grained metal layers comprise two or more different elements comprising Zn and Fe; Zn and Ni; Co and Ni; Ni and Fe; Ni and Cr; Ni and Al; Cu and Zn; Cu and Sn; or Al, Ni, and Co.

19. The method of claim 1, wherein the electrodeposition cell is configured such that a distance between the first portion of the anode assembly and the conductive workpiece can be adjusted by adjusting a position of the first portion of the anode assembly.

20. The method of claim 1, wherein the electrodeposition cell is configured such that a distance between the first portion of the anode assembly and the conductive workpiece can be adjusted by adjusting the path of the conductive workpiece.

21. A method comprising:

moving a workpiece through an electrolyte comprising salts of at least two metals by winding the workpiece around a plurality of rollers in a path that passes the workpiece between a first portion and a second portion of an anode assembly arranged in an electrodeposition cell, the workpiece being arranged a first distance from the first portion of the anode assembly and a second distance from the second portion of the anode assembly, the second distance being different than the first distance, the electrodeposition cell further comprising a cathode assembly; and electrodepositing a first nanolaminate coating on a first surface of the workpiece and a second nanolaminate coating on a second surface of the workpiece, the first and the second nanolaminate coatings each comprising a plurality of nanolaminate layers, each nanolaminate layer of the plurality of nanolaminate layers differing from adjacent nanolaminate layers in structure or composition, the first nanolaminate coating and the second nanolaminate coating having different thicknesses, the electrodepositing comprising:

applying a current density in a time varying manner to the workpiece as the workpiece moves through the electrodeposition cell, the current density being controlled by a power supply.

22. The method of claim 21, wherein the electrolyte is non-aqueous.

23. The method of claim 21, wherein the first and second nanolaminate coating comprise two or more elements selected from Ag, Al, Au, Be, Co, Cr, Cu, Fe, Hg, In, Mg, Mn, Mo, Nb, Nd, Ni, P, Pd, Pt, Re, Rh, Sb, Sn, Pb, Ta, Ti, W, V, Zn, and Zr, and wherein each of the two or more elements is present in the first and second nanolaminate coatings in a concentration greater than 0.1%, by weight.

24. The method of claim 21, wherein the electrodeposition cell comprises a mixer or an ultrasonic agitator.

25. The method of claim 24, wherein the mixer is operated at a varying rate or the ultrasonic agitator is operated in a non-continuous fashion.

26. The method of claim 21, wherein the electrodeposition cell is configured such that a distance between the first portion of the anode assembly and the workpiece can be adjusted by adjusting a position of the first portion of the anode assembly.

27. The method of claim 21, wherein the electrodeposition cell is configured such that a distance between the first portion of the anode assembly and the conductive workpiece can be adjusted by adjusting the path of the workpiece.

* * * * *